US006295249B1

(12) United States Patent
Takahashi et al.

(10) Patent No.: US 6,295,249 B1
(45) Date of Patent: Sep. 25, 2001

(54) DISPLAY CORRECTION DEVICE AND TIMEPIECE EQUIPPED WITH DISPLAY CORRECTION DEVICE

(75) Inventors: Masaaki Takahashi; Mamoru Watanabe, both of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/582,016

(22) PCT Filed: Dec. 24, 1998

(86) PCT No.: PCT/JP98/05940

§ 371 Date: Aug. 29, 2000

§ 102(e) Date: Aug. 29, 2000

(87) PCT Pub. No.: WO99/34262

PCT Pub. Date: Jul. 8, 1999

(30) Foreign Application Priority Data

Dec. 25, 1997 (JP) ..... 9-357352

(51) Int. Cl.[7] ..... G04B 19/20; G04B 19/24; G04B 27/02

(52) U.S. Cl. ..... 368/35; 368/190

(58) Field of Search ..... 368/34–37, 185, 368/190–199

(56) References Cited

U.S. PATENT DOCUMENTS 3,114,237 12/1963 Polo et al. ..... 58/71
3,797,226 * 3/1974 Inoki et al. .
3,983,691 * 10/1976 Schaller et al. .
4,469,448 * 9/1984 Muller .

FOREIGN PATENT DOCUMENTS 48018225 5/1973 (JP) .
48033336 10/1973 (JP) .
48081868 10/1973 (JP) .
53081059 7/1978 (JP) .

* cited by examiner

*Primary Examiner*—Vit Miska
(74) *Attorney, Agent, or Firm*—Adams & Wilks

(57) ABSTRACT

A correction device for a timepiece comprises a setting wheel which has a rotational center and which is rotatably mountable to a movement of a timepiece for undergoing rotation in accordance with rotation of a winding stem. A rocking bar has a rotational center on an axis line coinciding with an axis line of the rotational center of the setting wheel and is mounted for undergoing rocking movement in a first rotational direction relative to the movement of the timepiece and undergoing rocking movement in a second rotational direction different from the first rotational direction. The rocking bar has a first portion extended in a first direction from the rotational center and a second portion extended in a second direction from the rotational center. At least one first correction transfer wheel is disposed at the first portion of the rocking bar for undergoing rotation in accordance with rotation of the setting wheel. At least one second correction transfer wheel is disposed at the second portion of the rocking bar for undergoing rotation in accordance with rotation of the setting wheel.

60 Claims, 19 Drawing Sheets

DISPLAY CORRECTION DEVICE AND TIMEPIECE EQUIPPED WITH DISPLAY CORRECTION DEVICE

SUMMARY OF THE INVENTION

1. Field of the Invention

The present invention relates to a timepiece equipped with a display correction device constituted to be capable of correcting a display content displayed by display members of an hour hand, a minute hand, a date indicator, a day indicator and the like by rotating a winding stem.

Further, the invention relates to a correction device for a timepiece for correcting the display content by rotating the winding stem.

2. Background Information

According to a timepiece equipped with a display correction device, there has been used a rocking yoke provided at a main plate which is rockable to three positions by operating a setting lever. A setting wheel is rotatably provided to a rocking yoke. A calendar correction rocking lever is rockably provided to the rocking yoke. A calendar corrector setting wheel is rotatably provided to the calendar correction rocking lever and is arranged to be capable of slipping by constant slip torque.

When a winding stem exists at the 0-th stage, the rocking yoke is positioned at a first position in the axis line direction of the winding stem, and when the winding stem is rotated, a sliding pinion is rotated and the setting wheel and the calendar corrector setting wheel are rotated based on rotation of the sliding pinion. Under this state, there is no gear rotating based on rotation of the calendar corrector setting wheel.

When the winding stem is drawn to the first stage, the rocking yoke is rotated based on rotation of a setting lever. Then, the rocking yoke is positioned at a second position in the axis line direction of the winding stem. When the winding stem is rotated, the sliding pinion is rotated and the setting wheel and the calendar corrector setting wheel are rotated based on rotation of the sliding pinion. When the winding stem is rotated to the right, the calendar corrector rocking lever is rocked in a first direction, based on rotation of the calendar corrector setting wheel, a day indicator is rotated and day correction is carried out. When the winding stem is rotated to the left, the calendar corrector rocking lever is rocked in a second direction reverse to the first direction and based on the rotation of the calendar corrector setting wheel, a day corrector setting wheel is rotated. Based on rotation of the day corrector setting wheel, the day wheel is rotated and day correction is carried out.

When the winding stem is drawn to the second stage, based on rotation of the setting lever, the rocking yoke is rotated. Then, the rocking yoke is positioned to a second position in the axis line direction of the winding stem. When the winding stem is rotated, the sliding pinion is rotated and based on rotation of the sliding pinion, the setting wheel and the calendar corrector setting wheel are rotated. Under this state, there is no gear rotating based on the rotation of the calendar corrector setting wheel. When the winding stem is rotated, based on rotation of the setting wheel, a minute wheel is rotated. By rotating the minute wheel, a minute driving wheel and an hour wheel are rotated. Therefore, based on the rotation of the winding stem, display of a minute hand attached to the minute driving wheel and an hour hand attached to the hour wheel can be corrected.

According to such a conventional structure, the sliding pinion is constituted to move to three locations of the first position in correspondence with the 0-th stage of the winding stem, the second position in correspondence with the first stage of the winding stem and the third position in correspondence with the second stage of the winding stem. Further, the setting wheel, the calendar correction rocking lever and the calendar corrector setting wheel are attached to the rocking yoke.

However, according to the conventional timepiece equipped with a display correction device, the following problems are posed.

(1) When the winding stem is rotated and display of the date indicator and the day indicator is corrected to thereby correct time, the sliding pinion is moved to the three locations of the positions in the rotational axis line of the winding stem and accordingly, an amount of moving the sliding pinion is large. Therefore, a dimension of a movement of a timepiece with regard to the axis line direction of the winding stem becomes large.

(2) There is used the rocking yoke mounted with a plurality of parts and accordingly, shapes of parts constituting the display correction device are complicated and a large period of time is required in fabrication of the parts and assembly of the timepiece.

Hence, in order to resolve such conventional problems, objects of the invention reside in points described below.

(1) A movement of a timepiece equipped with a display correction device is to be downsized by realizing a display correction device in which an amount of moving a sliding pinion in an axis line direction of a winding stem is small.

(2) A timepiece equipped with a display correction device in which fabrication and assembly are facilitated is to be realized by simplifying shapes of parts constituting the display correction device.

SUMMARY OF THE INVENTION (1) In order to resolve the above-described problems in the conventional art according to the invention, there is constituted a timepiece equipped with a display correction device capable of correcting a display content by rotation of a winding stem having a first information display member for displaying first information and a second information display member for displaying second information. The first information display member is constituted by, for example, a date display member for displaying date, that is, a date indicator or the like and the second information display member is constituted by, for example, a time display member for displaying time, that is, an hour hand and a minute hand or the like.

Further, the timepiece equipped with a display correction device according to the invention is provided with a winding stem having a rotational axis line for correcting a display content of the first information display member and correcting a display content of the second information display member, a sliding pinion having a rotational axis line the same as the rotational axis line of the winding stem and provided to rotate based on rotation of the winding stem, winding stem positioning means for positioning the winding stem at a first winding stem position in a direction of the rotational axis line, a second winding stem position in the direction of the rotational axis line and a third winding stem position in the direction of the rotational axis line, and sliding pinion positioning means for positioning the sliding pinion at a first sliding pinion position in the direction of the rotational axis line when the winding stem is disposed at the first winding stem position and for positioning the sliding pinion at a second sliding pinion position in the direction of the rotational axis line when the winding stem is disposed at the second winding stem position and the third winding stem position based on movement of the winding stem in the direction of the rotational axis line.

Further, the timepiece equipped with a display correction device according to the invention is provided with a rocking bar having a rotational center on the rotational axis line of the winding stem and provided to rock in a first rotational direction when the winding stem is disposed at the second winding stem position and to rock in a second rotational direction different from the first rotational direction when the winding stem is disposed at the third position, first corrector setting means provided to the rocking bar for correcting the display content of the first information display member based on rotation of the sliding pinion when the winding stem is disposed at the second winding stem position, and second corrector setting means for correcting the display content of the second information display member based on the rotation of the sliding pinion when the winding stem is disposed at the third winding stem position.

Further, the timepiece equipped with a display correction device according to the invention is preferably provided with a setting wheel having a rotational center disposed at a position the same as a position of the rotational center of the rocking bar and provided to rotate based on the rotation of the sliding pinion when the winding stem is disposed at the second winding stem position and the third winding stem position.

Further, the timepiece equipped with a display correction device according to the invention preferably includes one or more of correction transfer wheel provided to rotate based on rotation of the setting wheel and a corrector setting wheel provided to rotate based on rotation of the correction transfer wheel for correcting the display content of the first information display member.

Further, the timepiece equipped with a display correction device according to the invention preferably includes a rocking lever provided to rock based on the rotation of the correction transfer wheel when the winding stem is disposed at the second winding stem position and the corrector setting wheel is rotatably attached to the rocking lever.

By the forgoing construction, a timepiece equipped with a display correction device which is small-sized and which operates with certainty is realized.

Further, the timepiece equipped with a display correction device according to the invention preferably includes rocking lever positioning means for restraining a position in a rotational direction of the rocking lever.

By this construction the position of the rocking lever in the rotational direction can be determined with certainty.

Further, the timepiece equipped with a display correction device according to the invention preferably includes rocking bar positioning means for restraining a position in a rotational direction of the rocking bar.

By this construction, the position of the rocking lever in the rotational direction can be determined with certainty.

Further, the timepiece equipped with a display correction device according to the invention is preferably constituted such that rotation of the rocking bar is determined based on operation of the winding stem positioning means.

By this construction, the rocking bar can be rotated with certainty.

Further, the timepiece equipped with a display correction device according to the invention preferably includes a train wheel stop lever provided to operate based on the operation of the winding stem positioning means for restraining operation of the second information display member when the winding stem is disposed at the third winding stem position.

By this construction, the train wheel stop lever can be operated with certainty and a second hand of the timepiece can be stopped with certainty.

Further, according to the timepiece equipped with a display correction device according to the invention, rotation of the rocking bar is preferably determined based on the operation of the winding stem positioning means when the winding stem is disposed at the third winding stem position.

By the constitution, the rocking bar can be rotated with certainty.

Further, the timepiece equipped with a display correction device according to the invention preferably includes a third information display member for displaying third information wherein when the winding stem is disposed at the second winding stem position, in the case in which the winding stem is rotated in a first winding stem rotating direction, the rocking lever is rotated in a first rocking lever rotating direction and the corrector setting wheel corrects the first information display member, and wherein when the winding stem is disposed at the second winding stem position, in the case in which the winding stem is rotated in a second winding stem rotating direction different from the first winding stem rotating direction, the rocking lever is rotated in a second rocking lever rotating direction different from the first rocking lever rotating direction and the corrector setting wheel corrects the third information display member.

The third information display member is constituted by, for example, a day display member, that is, a day indicator.

By this construction, correction of the three information display members can be carried out with certainty.

Further, according to the timepiece equipped with a display correction device of the invention, the second correcting means includes one or more of intermediate minute wheel provided to rotate based on rotation of the setting wheel and including a minute wheel provided to rotate based on rotation of the intermediate minute wheel when the winding stem is disposed at the third winding stem position.

By this construction, hand setting can be carried out with certainty.

Further, the timepiece equipped with a display correction device according to the invention is preferably constituted such that when the timepiece is constituted by a mechanical type timepiece having a balance with hairspring and when the winding stem is disposed at the third winding stem position, the train wheel stop lever restrains the balance with hairspring.

By this construction, there can be realized the mechanical type timepiece having a train wheel stop device which is small-sized and operated with certainty.

Further, the timepiece equipped with a display correction device according to the invention is preferably constituted such that the timepiece includes a front train wheel for displaying second and when the winding stem is disposed at the third winding stem position, the train wheel stop lever restrains one gear in the front train wheel.

By this construction, the front train wheel can be restrained with certainty.

(2) Further, according to the invention, there is provided a timepiece equipped with a display correction device capable of correcting a display content by rotation of a winding stem, including a time display member for displaying time, a date display member for displaying date, a day display member for displaying day, a winding stem having a rotational axis line for correcting a display content of the time display member, the date display member and the day display member and a sliding pinion having a rotational axis line the same as the rotational axis line of the winding stem and rotated based on the rotation of the winding stem.

There is provided a switch device for positioning the winding stem at a first winding stem position in a direction of the rotational axis line, a second winding stem position in the direction of the rotational axis line and a third winding stem position in the direction of the rotational axis line, positioning the sliding pinion at a first sliding pinion position in the direction of the rotational axis line when the winding stem is disposed at the first winding stem position and positioning the sliding pinion at a second sliding pinion position in the direction of the rotational axis line when the winding stem is disposed at the second winding stem position and the third winding stem position based on movement of the winding stem in the direction of the rotational axis line.

There is provided a rocking bar having a rotational center on the rotational axis line of the winding stem and provided to rock in a first rotational direction when the winding stem is disposed at the second winding stem position and rock in a second rotational direction different from the first rotational direction when the winding stem is disposed at the third position.

The timepiece equipped with a display correction device according to the invention further includes a setting wheel having a rotational center at a position the same as a position of the rotational center of the rocking bar and provided to rotate based on rotation of the sliding pinion when the winding stem is disposed at the second winding stem position and the third winding stem position, a first corrector setting train wheel provided to the rocking bar for correcting the display content of the date display member and the day display member based on rotation of the setting wheel when the winding stem is disposed at the second winding stem position, and a second corrector setting train wheel provided to the rocking bar for correcting the display content of the time display member based on the rotation of the setting wheel when the winding stem is disposed at the third winding stem position.

The timepiece equipped with a display correction device according to the invention is preferably constituted such that the first corrector setting train wheel includes one or more of correction transfer wheel provided to rotate based on the rotation of the setting wheel, wherein the timepiece equipped with the display correction device includes a rocking lever provided to rock based on rotation of the correction transfer wheel when the winding stem is disposed at the second winding stem position, and a corrector setting wheel attached to the rocking lever to rotate based on the rotation of the correction transfer wheel when the winding stem is disposed at the second winding stem position, wherein when the winding stem is at the second winding stem position, in the case in which the winding stem is rotated in a first winding stem rotating direction the rocking bar is rotated in a first rocking lever rotating direction and the corrector setting wheel corrects the date display member, and wherein when the winding stem is disposed at the second hand setting position, in the case in which the winding stem is rotated in a second winding stem rotating direction different from the first winding stem rotating direction, the rocking lever is rotated in a second rocking lever rotating direction different from the first rocking lever rotating direction and the corrector setting wheel corrects the day display member.

According to the timepiece equipped with a display correction device of the invention, it is preferable that the second corrector setting train wheel includes one or more of intermediate minute wheel provided to rotate based on rotation of the setting wheel and including a minute wheel provided to rotate based on rotation of the intermediate minute wheel via rotation of the intermediate minute wheel when the winding stem is disposed at the third winding stem position.

The timepiece equipped with a display correction device according to the invention preferably includes a train wheel stop lever operated based on operation of the switch device for restraining operation of the time display member when the time setting stem is disposed at the third winding stem position.

By such a constitution, the amount of moving the sliding pinion in the axis line direction of the winding stem can be reduced. Therefore, the movement of the timepiece equipped with the display correction device can be downsized.

Further, the shapes of parts constituting the display correction device of the timepiece can be simplified.

Therefore, fabrication and assembly of the timepiece can be facilitated.

Further, according to the timepiece equipped with a display correction device of the invention, the first corrector setting train wheel is arranged at a first region on one side of a reference axis line when the rotational axis line of the winding stem is made to constitute the reference axis line of the timepiece, and the second corrector setting train wheel is arranged at a second region on other side of the reference axis line.

By the foregoing construction, there can be realized the small-sized timepiece equipped with the display correction device.

(3) Further, according to the invention, there is provided a correction device for a timepiece for correcting a display content based on rotation of a winding stem, including a gear for corrector setting having a rotational center which is not moved relative to a movement of the timepiece and rotatably fixed to the movement to be rotatable based on the rotation of the winding stem, a rocking bar having a rotational center on an axis line the same as an axis line of the rotational center of the gear for corrector setting, including a first portion extended in a first direction from the rotational center and a second portion extended in a second direction from the rotational center, rockable in a first rotational direction relative to the movement and rockable in a second rotational direction different from the first rotational direction, at least one first correction transfer wheel provided at the first portion of the rocking bar to rotate based on rotation of the gear for corrector setting, and at least one second correction transfer wheel provided at the second portion of the rocking bar to rotate based on the rotation of the gear for corrector setting.

The gear for corrector setting is constituted as, for example, a setting wheel.

By the foregoing construction, there can be realized the small-sized correction device for a timepiece by a small number of parts.

DETAILED DESCRIPTION OF THE PREFERRED EMBODIMENTS

An explanation will be given of embodiments of a timepiece equipped with a display correction device by rotation of a winding stem according to the invention in reference to the drawings as follows.

(1) A structure of a first embodiment of a timepiece equipped with a display correction device according to the invention.

Figure 1:
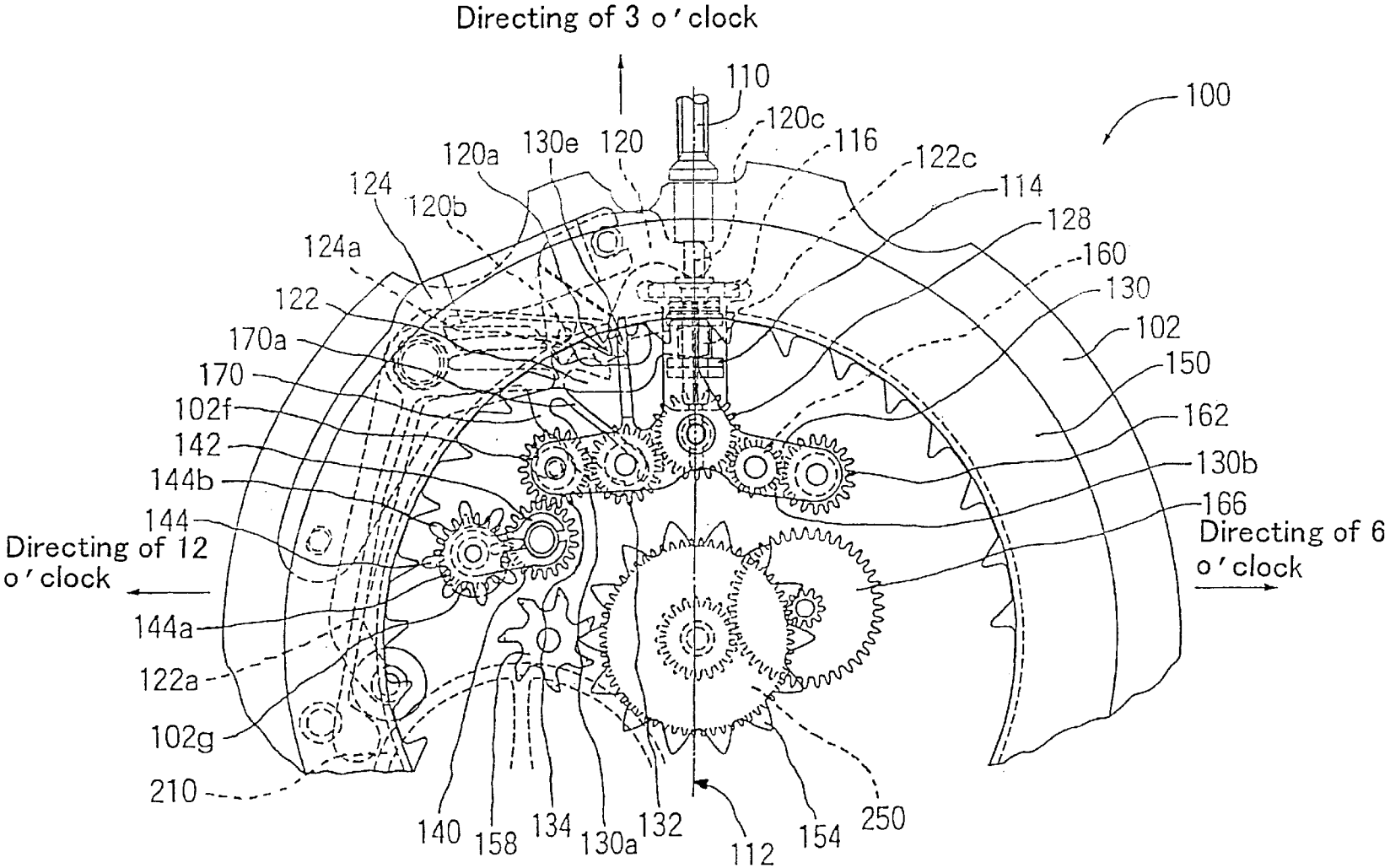
FIG. 1 is a partial plane view showing a structure of a back side of a first embodiment of a timepiece equipped with a display correction device according to the invention when a winding stem exits at the 0-th stage.
Figure 2:
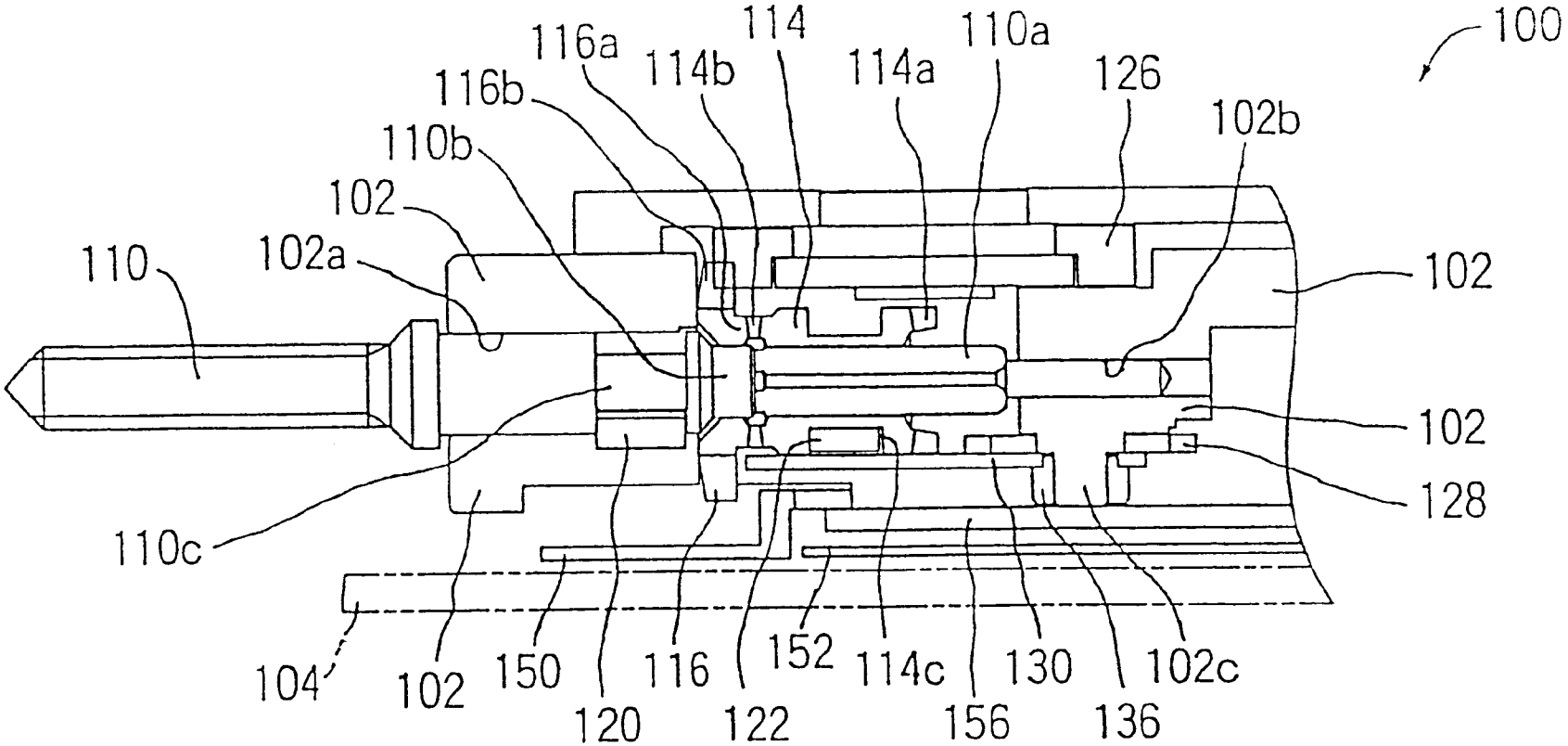
FIG. 2 is a partial sectional view of the first embodiment of the timepiece equipped with a display correction device according to the invention when the winding stem exists at the 0-th stage.

In reference to FIG. 1 and FIG. 2, a movement (machine body) 100 of a first embodiment of a timepiece equipped with a display correction device according to the invention is constituted by a mechanical timepiece and is provided with a main plate 102 constituting a base plate of the movement. A winding stem 110 is rotatably integrated to winding stem guide holes 102*a* and 102*b*. A dial 104 is attached to the movement 100.

In both sides of the main plate 102, a side where the dial 104 is disposed is referred to as "back side" of the movement and a side thereof opposed to the side where the dial 104 is disposed is referred to as "front side" of the movement. A train wheel integrated to the "front side" of the movement is referred to as "front train wheel" and a train wheel integrated to the "back side" of the movement is referred to as "back train wheel".

In the case of a timepiece, there are normally provided numerals of from 1 to 12 or abbreviated characters in correspondence therewith or the like are provided at an outer peripheral portion of a surface of the dial 104. Therefore, respective directions along the outer peripheral portion of the timepiece can be expressed by using the numerals.

For example, in the case of a wrist watch, upper direction and upper side of the wrist watch are respectively referred to as "direction of 12 o'clock" and "side of 12 o'clock", right direction and right side of the wrist watch are respectively referred to as "direction of 3 o'clock" and "side of 3 o'clock", lower direction and lower side of the wrist watch are respectively referred to as "direction of 6 o'clock" and "side of 6 o'clock", left direction and left side of the wrist watch are respectively referred to as "direction of 9 o'clock" and "side of 9 o'clock".

Similarly, directions in correspondence with from 1 o'clock scale to 11 o'clock scale are respectively referred to as from "direction of 1 o'clock" to "direction of 11 o'clock" and positions in correspondence with from 1 o'clock scale to 11 o'clock scale of the dial 104 are respectively referred to as from "1 o'clock position" to "11 o'clock position".

For example, in FIG. 1, the winding stem 110 is arranged in "direction of 3 o'clock" of the movement. A straight line including a rotational axis line of the winding stem 110 is defined as a reference axis line 112 of the timepiece.

On the back side of the movement, a region on the left side of the reference axis line 112 is defined as "first region" of the movement. The "first region" is referred to as "3–12–9 o'clock region" in correspondence with the numerals of the dial. Therefore, on the front side of the movement, a region on the right side of the reference axis line 112 becomes the "first region" of the movement.

On the back side of the movement, a region on the right side of the reference axis line 112 is defined as "second region" of the movement. The "second region" is referred to as "3–6–9 o'clock region" in correspondence with the numerals of the dial. Therefore, on the front side of the movement, a region on the left side of the reference axis line 112 becomes the "second region" of the movement.

The winding stem 110 is provided with a square portion 110*a* and a guide shaft portion 110*b*. A sliding pinion 114 is integrated to the square portion 110*a* of the winding stem 110. The sliding pinion 114 is provided with a rotational axis line the same as a rotational axis line of the winding stem 110. That is, the sliding pinion 114 is provided with a square hole and is provided to rotate based on rotation of the winding stem 110 by fitting the square hole to the corner portion 110*a*. The sliding pinion 114 is provided with an A tooth 114a and a B tooth 114*b*. The A tooth 114*a* is provided at an end portion of the sliding pinion 114 proximate to the center of the movement. The B tooth 114*b* is provided at an end portion of the sliding pinion remote from the center of the movement.

A winding pinion 116 is rotatably provided at the guide shaft portion 110*b* of the winding stem 110. The winding pinion 116 is provided with an inner side tooth 116*a* and an outer side tooth 116*b*. In a state in which the winding stem 110 is disposed at a first winding stem position (0-th stage) most proximate to the inner side of the movement along the rotational axis line, the B tooth 114*b* of the winding pinion 116 is in mesh with the inner side tooth 116*a* of the winding pinion 116. Therefore, under the state, it is constituted that when the winding stem 110 is rotated, the winding pinion 116 is rotated via rotation of the sliding pinion 114. Under a state in which the hand setting wheel 110 is disposed at the "first stage" and the "second stage", it is constituted that the B tooth 114*b* of the sliding pinion 114 is not in mesh with the inner side tooth 116*a* of the winding pinion 116.

A setting lever 120 is rotatably arranged on the back side of the main plate 102. A yoke 122 is rotatably arranged on the back side of the main plate 102. The yoke 122 is urged to press to a front end portion 120*a* of the setting lever 120 by spring force of a yoke spring portion 122*a*. A yoke holder 124 is provided to press the setting lever 120 and the yoke 122. A yoke positioning pin 120*b* provided at the setting lever 120 is engaged with a yoke positioning ridge portion 124*a* of the yoke holder 124 and by the yoke holder 124, the setting lever 120 is positioned to three positions in a rotational direction.

A winding stem guide portion 120*c* of the setting lever 120 is engaged with a stepped portion 110*c* of the winding stem 110 and determines a position of the winding stem 110 in a rotational axis line direction based on rotation of the setting lever 120. A sliding pinion guide portion 122*c* of the yoke 122 is engaged with a stepped portion 114*c* of the sliding pinion 114 and determines a position of the sliding pinion 114 in a rotational axis line direction based on rotation of the yoke 122. Based on rotation of the setting lever 120, the yoke 122 is positioned to two positions in the rotational direction.

In the case of the constitution of the timepiece equipped with a display correction device according to the invention, under the state in which the winding stem 110 is disposed at the "0-th stage", the sliding pinion 114 is disposed at the first position on a side proximate to an outer side of the movement and under the state in which the winding stem 110 is disposed at the "first stage" and the "second stage", the sliding pinion 114 is disposed at the second position proximate to an inner side of the movement.

The setting lever 120, the yoke 122 and the yoke holder 124 constitute a switch device of the timepiece equipped with a display correction device. The setting lever 120 and the yoke positioning ridge portion 124*a* of the yoke holder 124 constitute winding stem positioning means for positioning a position of the winding stem 110 in the rotational axis line direction. The yoke 122 constitutes sliding pinion positioning means operated based on an operation of the setting lever 120 and the yoke holder 124.

A setting wheel pin 102*c* constituting the rotational center of a setting wheel is provided on the back side of the main plate 102 and on the rotational axis line of the winding stem 110. A setting wheel 128 is rotatably provided to the setting wheel pin 102*c*. The setting wheel 128 is constituted to be not in mesh with the A tooth 114*a* of the sliding pinion 114 under the state in which the winding stem 110 is disposed at the "0-th stage" and in mesh with the A tooth 114*a* of the sliding pinion 114 under the state in which the winding stem 110 is disposed at the "first stage" and the "second stage".

A rocking bar 130 is rockably provided with the setting wheel pin 102*c* as the rotational center. A rocking bar holding frame 136 is fitted to a top portion of the setting wheel pin 102*c*. The rocking bar holding frame 136 is provided to rockably hold the rocking bar 130. The rocking bar holding frame 136 may be fixedly attached to the top portion of the setting wheel pin 102*c*, or, the rocking bar holding frame 136 may be arranged at the top portion of the setting wheel pin 102*c*.

The rocking bar 130 includes a rocking bar first portion 130*a* extended to one side of the setting wheel pin 102*c*, that is, into the "first region" arranged on the left side of the reference axis line 112 and a rocking bar second portion 130*b* extended to other side of the setting wheel pin 102*c*, that is, into the "second region" arranged on the right side of the reference axis line 112. The rocking bar 130 is provided with a setting lever engaging portion 130*e*. The setting lever engaging portion 130*e* of the rocking bar 130 may be constituted as an elastically deformable spring portion.

A first correction transfer wheel 132 is rotatably attached to the rocking bar first portion 130*a*. A second correction transfer wheel 134 is rotatably attached to the rocking bar first portion 130*a*. The first correction transfer wheel 132 is in mesh with the setting wheel 128 and the second correction transfer wheel 134. The first correction transfer wheel 132 is provided with a first correction transfer wheel shaft portion 132*a*.

The second correction transfer wheel 134 is provided with a second correction transfer wheel shaft portion 134*a*. A rocking bar positioning hole 102*f* is provided at the main plate 102. The second correction transfer wheel shaft portion

134*a* is arranged in the rocking bar positioning hole 102*f*. A position in the rotational direction of the rocking bar 130 is determined by bringing the second correction transfer wheel shaft portion 134*a* in contact with a cylindrical wall face of the rocking bar positioning hole 102*f*.

Therefore, the first correction transfer wheel 132 and the second correction transfer wheel 134 constitute a first corrector train wheel provided at the rocking bar 130 for correcting display content of a date indicator 150 and a day indicator 152 based on the rotation of the setting wheel 128 when the winding stem 110 is disposed at the second winding stem position (first stage).

Although a number of the correction transfer wheels constituting the first corrector train wheel is preferably two, the number may be one or may be three or more.

A third correction transfer wheel 140 is rotatably provided at the main plate 102. A rocking lever 142 is rockably provided to the third correction transfer wheel. The rocking lever 142 is attached to the third correction transfer wheel 140 such that the third correction transfer wheel 140 can slip against the rocking lever 142 when constant slip torque is exceeded. The embodiment of the invention may be constituted such that the slip torque is 1 to 2 g·cm.

A corrector setting wheel 144 is rotatably provided to the rocking lever 142. The corrector setting wheel 144 is provided with a corrector setting pinion 144*a*, a corrector setting gear 144*b* and a corrector setting wheel shaft portion 144*c*. The third correction transfer wheel 140 is in mesh with the second correction transfer wheel 134 and the corrector setting pinion 144*a*. A rocking lever positioning hole 102*g* is provided at the main plate 102. The corrector setting wheel shaft portion 144*c* is arranged in the rocking lever positioning hole 102*g*. A position in the rotational direction of the rocking lever 142 is determined by bringing the corrector setting wheel shaft portion 144*c* in contact with a cylindrical wall face of the rocking lever positioning hole 102*g*.

The date indicator 150 constituting a date display member for displaying date is rotatably integrated to the main plate 102. The date indicator 150 is provided with 31 of date indicator teeth and is rotated by a date feeding mechanism (not illustrated). A position in the rotational direction of the date indicator 150 is determined by a date jumper (not illustrated). A date indicator holder 156 holds the date indicator 150.

The day indicator 152 constituting a day display member for displaying day of the week is provided. The day indicator 152 is provided with a day star wheel 154 having 14 of teeth and the day indicator 152 is rotated by a day feeding mechanism (not illustrated). A position in the rotational direction of the day indicator 152 is determined by a day jumper (not illustrated).

A day corrector setting wheel 158 is rotatably integrated. The day corrector setting wheel 158 is in mesh with the day star wheel 154.

A first intermediate minute wheel 160 is rotatably attached to the rocking bar second portion 130*b*. A second intermediate minute wheel 162 is rotatably attached to the rocking bar second portion 130*b*. The first intermediate minute wheel 160 is in mesh with the setting wheel 128 and the second intermediate minute wheel 162. A minute wheel 166 is arranged at the "second region" on the right side of the reference axis line 112.

Therefore, the first intermediate minute wheel 160 and the second intermediate minute wheel 162 constitute a second correction train wheel provided to the rocking bar 130 for correcting the display content of the time display member by rotating the minute wheel 166 based on rotation of the setting wheel 128 when the winding stem 110 is disposed at the third winding stem position (second stage).

Although a number of the intermediate minute wheels for constituting the second correction train wheel is preferably two, the number may be one or may be three or more.

A train wheel stop lever 170 operated based on operation of the switch device for restraining operation of a time display member, is rotatably provided with the rotational center of the yoke 122 as the center. When the winding stem 110 is disposed at the 0-th stage and the first stage, by the setting lever 120, the train wheel stop lever 170 is rotated in the clockwise direction and a rocking bar contact portion 170*a* of the train wheel stop lever 170 is positioned by being brought into contact with the first correction transfer wheel shaft portion 132*a*.

By pushing the first correction transfer wheel shaft portion 132*a* by the train wheel stop lever 170, the rocking bar 130 is rotated in the counterclockwise direction. As described above, the position in the rotational direction of the rocking bar 130 is determined by rotating the rocking bar 130 in the counterclockwise direction and bringing the second correction transfer wheel shaft portion 134*a* in contact with the cylindrical wall face of the rocking bar positioning hole 102*f*. Under the state, the train wheel stop lever 170 is not brought into contact with a balance with hairspring 210.

(2) Structure and operation of the first embodiment of the timepiece equipped with the display correction device according to the invention in the state in which the winding stem is disposed at the 0-th stage.

Figure 3:
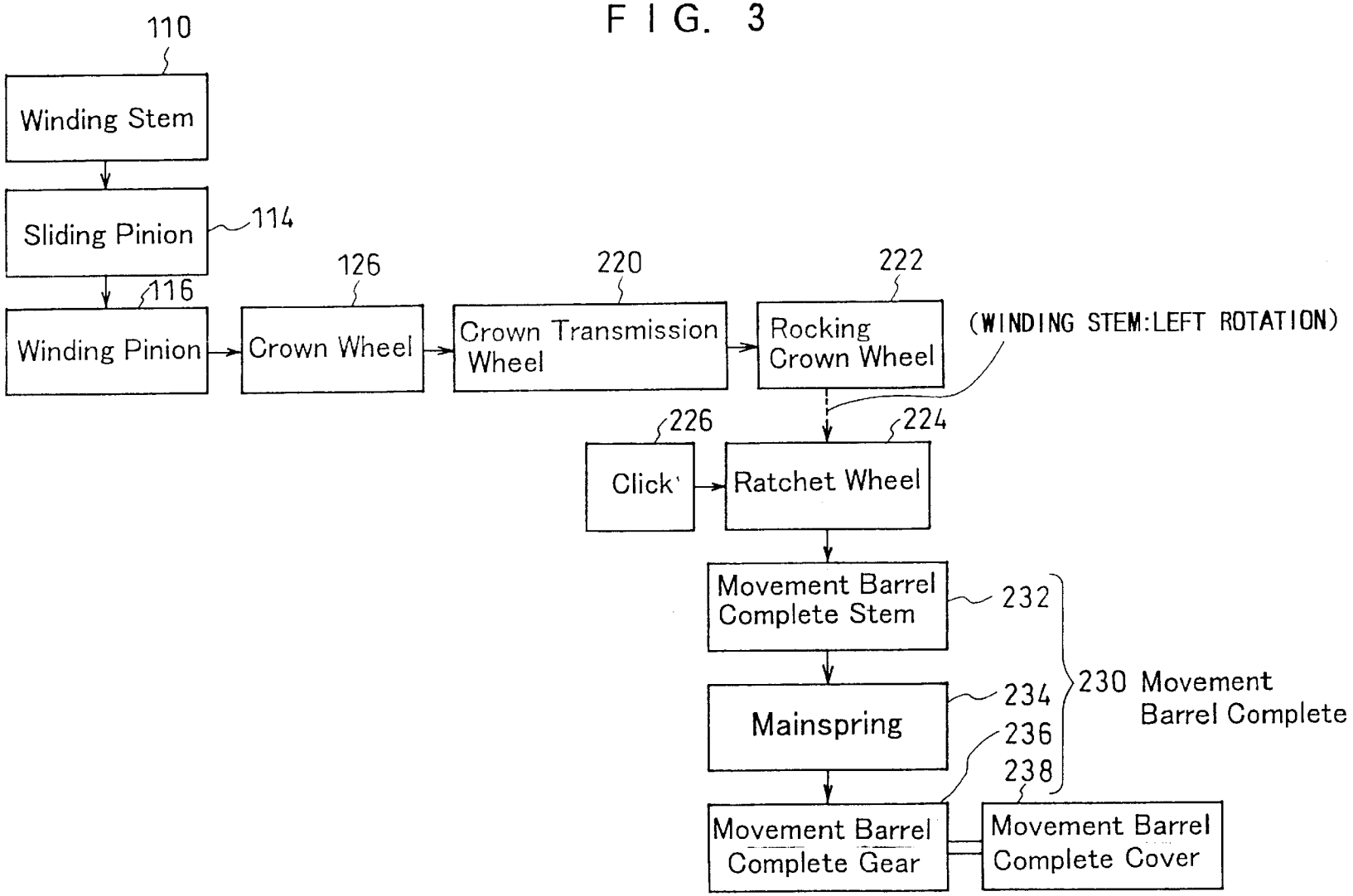
FIG. 3 is a functional block diagram of the first embodiment of the timepiece equipped with a display correction device according to the invention when the winding stem exists at the 0-th stage.

In reference to FIG. 1 through FIG. 3, in the state in which the winding stem 110 is disposed at the 0-th stage, the B tooth 114*b* of the sliding pinion 114 is in mesh with the inner side tooth 116*a* of the winding pinion. Therefore, when the winding stem 110 is rotated to the right (when the winding stem 110 is rotated in the clockwise direction in view from an outer side of the timepiece), the winding pinion 116 is rotated based on rotation of the sliding pinion 114 and a crown wheel 126 is rotated. A crown transmission wheel 220 is rotated based on rotation of the crown wheel 126. By rotation of the crown transmission wheel 220, a rocking crown wheel 222 is rocked while being rotated, in mesh with a ratchet wheel 224 and rotates the ratchet wheel 224 in a constant direction. A click 226 is provided to hamper rotation of the ratchet wheel 224 in the reverse direction.

A movement barrel complete 230 includes a movement barrel complete stem 232, a mainspring 234, a movement barrel complete gear 236 and a movement barrel complete cover 238. Based on rotation of the ratchet wheel, the movement barrel complete stem is rotated and winds up the mainspring 234. By power of the mainspring 234, the movement barrel complete gear 236 is rotated in a constant direction. Based on rotation of the movement barrel complete gear 236, the front train wheel is rotated and a second hand and a minute hand constituting the time display member are rotated. The rotational speed of the front train wheel is controlled by a speed control device including the balance with hairspring 210 and an escapement device. Based on rotation of the front train wheel, the back train wheel including the minute wheel 166 and the hour wheel is rotated to thereby rotate the hour hand. Further, based on rotation of the back train wheel, a date feed mechanism is operated, the date indicator 150 is rotated, a day feed mechanism is operated and the day indicator 152 is rotated.

(3) Structure and operation of the display correction device of the first embodiment of the timepiece equipped with the display correction device according to the invention under the state in which the winding stem is disposed at the first stage.

Figure 4:
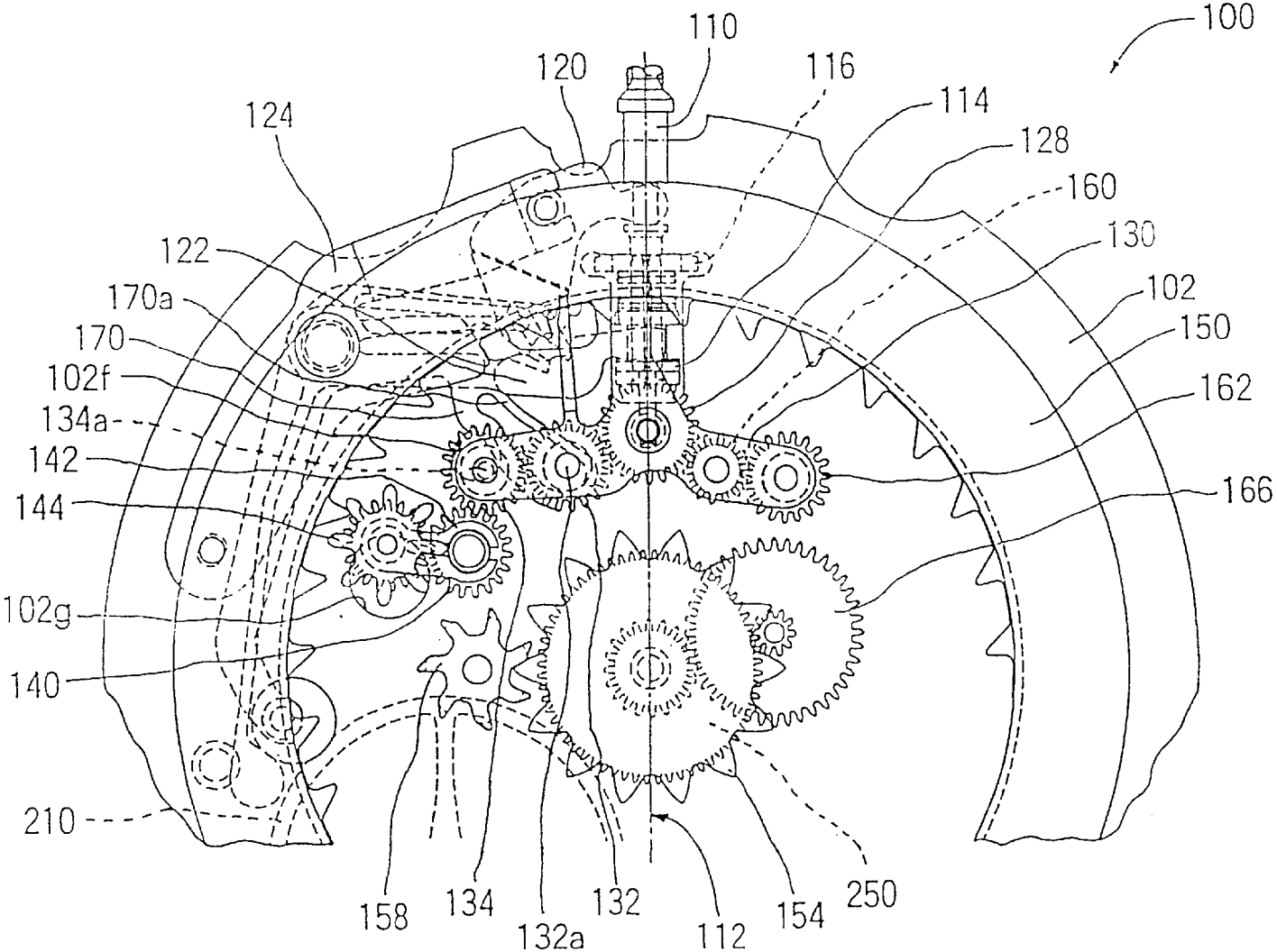
FIG. 4 is a partial plane view showing the structure of the back side of the first embodiment of the timepiece equipped with a display correction device according to the invention in a state in which the winding stem exists at the first stage and date correction is carried out.
Figure 5:
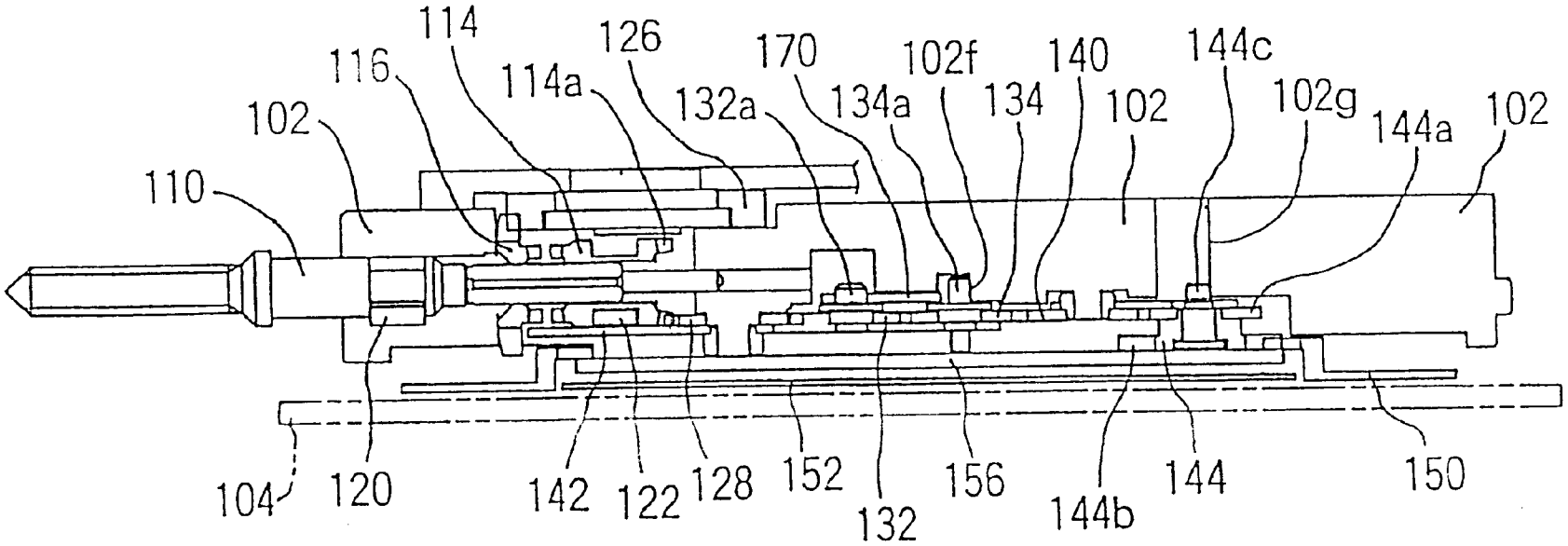
FIG. 5 is a partial sectional view of the first embodiment of the timepiece equipped with a display correction device according to the invention in the state in which the winding stem exists at the first stage and the date correction is carried out.
Figure 6:
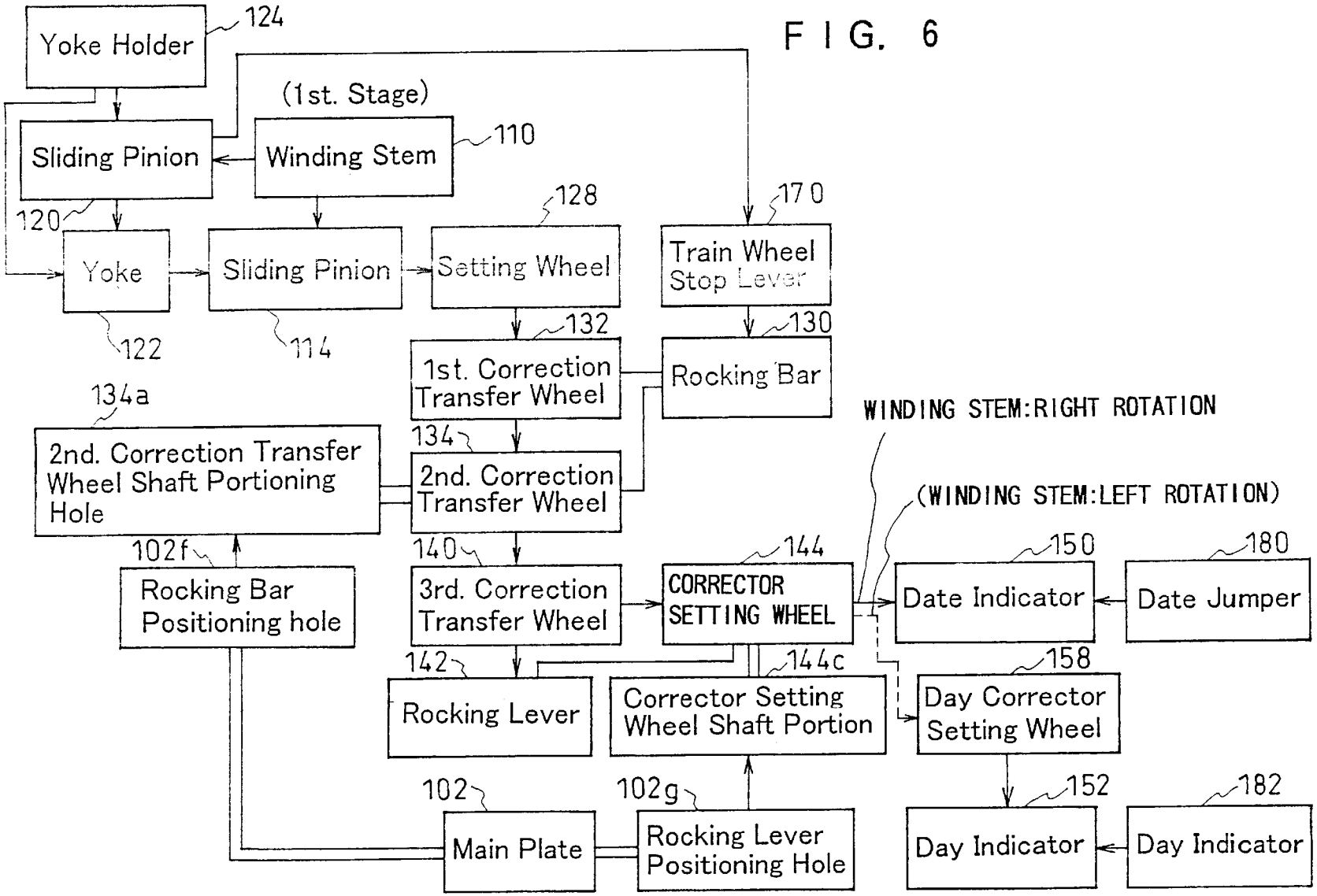
FIG. 6 is a functional block diagram of the first embodiment of the timepiece equipped with a display correction device according to the invention in a state in which the winding stem exists at the first stage and date correction or day correction is carried out.

(3-1) Operation of date correction:

In reference to FIG. 4 through FIG. 6, the winding stem 110 is drawn by one stage from the state in which the winding stem 110 is disposed at the 0-th stage to the state in which the winding stem 110 is disposed at the first stage. When the winding stem 110 is drawn by one stage, the setting lever 120 is rotated in the counterclockwise direction and the yoke 122 is rotated in the clockwise direction. Under the state, the A tooth 122*a* of the sliding pinion 114 is in mesh with the setting wheel 128 and the B tooth 122*b* of the sliding pinion 114 is not in mesh with the winding pinion 116.

When the winding stem 110 is disposed at the first stage, as described above, the train wheel stop lever 170 is rotated in the clockwise direction by the setting lever 170 and the rocking bar contact portion 170*a* of the train wheel stop lever 170 is positioned by being brought into contact with the first correction transfer wheel shaft portion 132*a*. By the operation of the train wheel stop lever 170, the rocking bar 130 is rotated in the counterclockwise direction and the second correction transfer wheel shaft portion 134*a* is brought into contact with a cylindrical wall face of the rocking bar positioning hole 102*f* proximate to the 9 o'clock side. Under the state, the train wheel stop lever 170 is not brought into contact with the balance with hairspring 210.

When the winding stem 110 is rotated to the right (when the winding stem 110 is rotated in the clockwise direction in view from the outer side of the timepiece), based on rotation of the sliding pinion 114, the setting wheel 128 is rotated in the counterclockwise direction. Based on rotation of the setting wheel 128, the first correction transfer wheel 132 is rotated in the clockwise direction. Based on rotation of the first correction transfer wheel 132, the second correction transfer wheel 134 is rotated in the counterclockwise direction. Based on rotation of the second correction transfer wheel 134, the third correction transfer wheel 140 is rotated in the clockwise direction. Then, the rocking lever 142 is rotated in the clockwise direction and the corrector setting wheel shaft portion 144*c* is positioned by being brought into contact with a cylindrical wall face of the rocking lever positioning hole 102*g* on a side proximate to the 3 o'clock side. Under the state, when the winding stem 110 is rotated to the right, the third correction transfer wheel 140 can be made to slip against the rocking lever 142.

Based on rotation of the third correction transfer wheel 140, the corrector setting wheel 144 is rotated in the counterclockwise direction at a position shown by FIG. 4. Based on such rotation of a corrector setting gear 144*b*, the date wheel 150 is rotated in the counterclockwise direction. The position in the rotational direction of the date indicator 150 is determined by a date jumper 180.

As has been explained, according to the timepiece of the invention, by rotating the hand setting lever 110 to the right in the state in which the winding stem 110 is disposed at the first stage, date correction can be carried out.

(3-2) Operation of day correction

Figure 7:
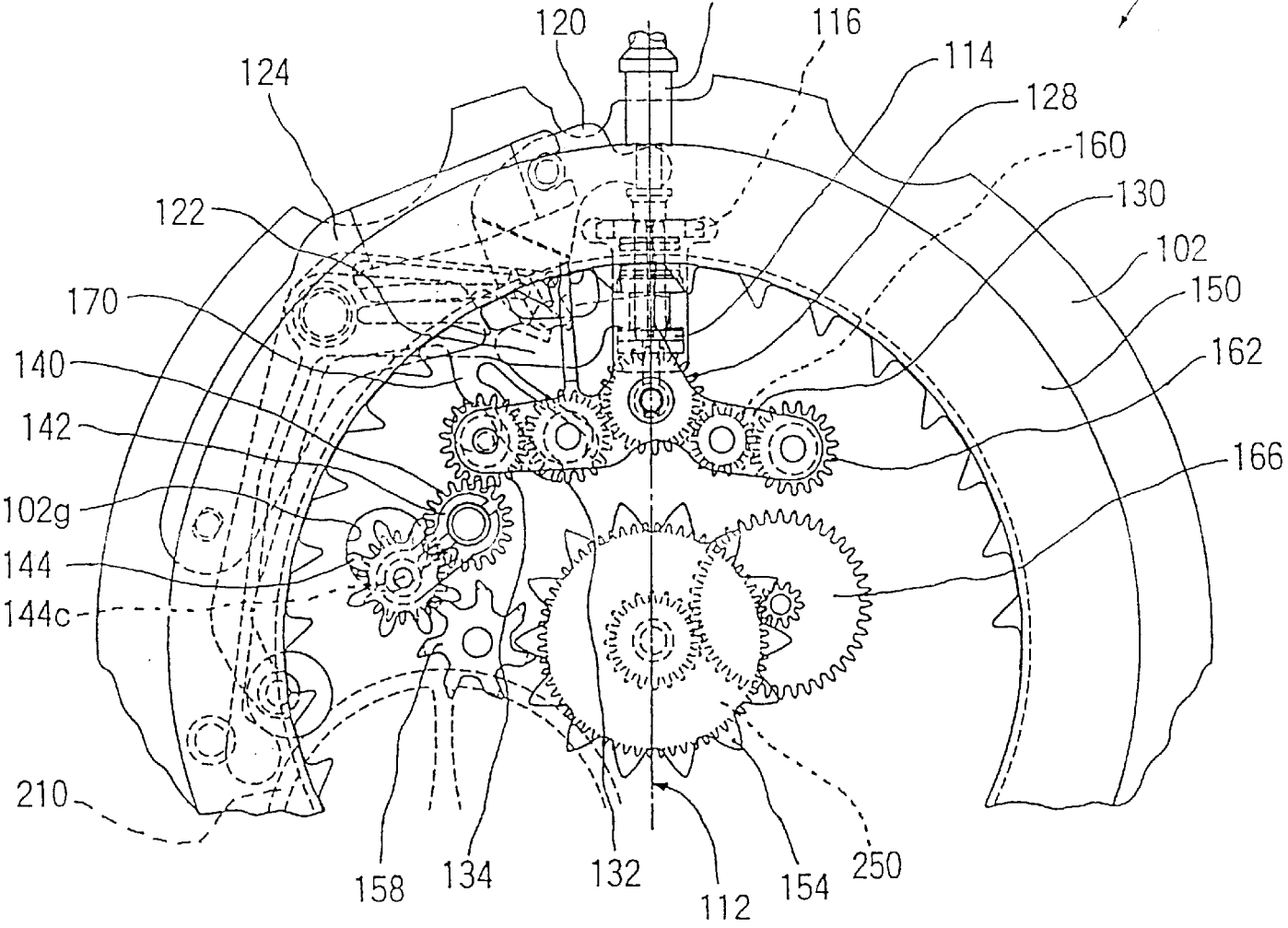
FIG. 7 is a partial plane view showing the structure of the back side of the first embodiment of the timepiece equipped with the display correction device according to the invention in the state in which the winding stem exists at the first stage and the day correction is carried out.
Figure 8:
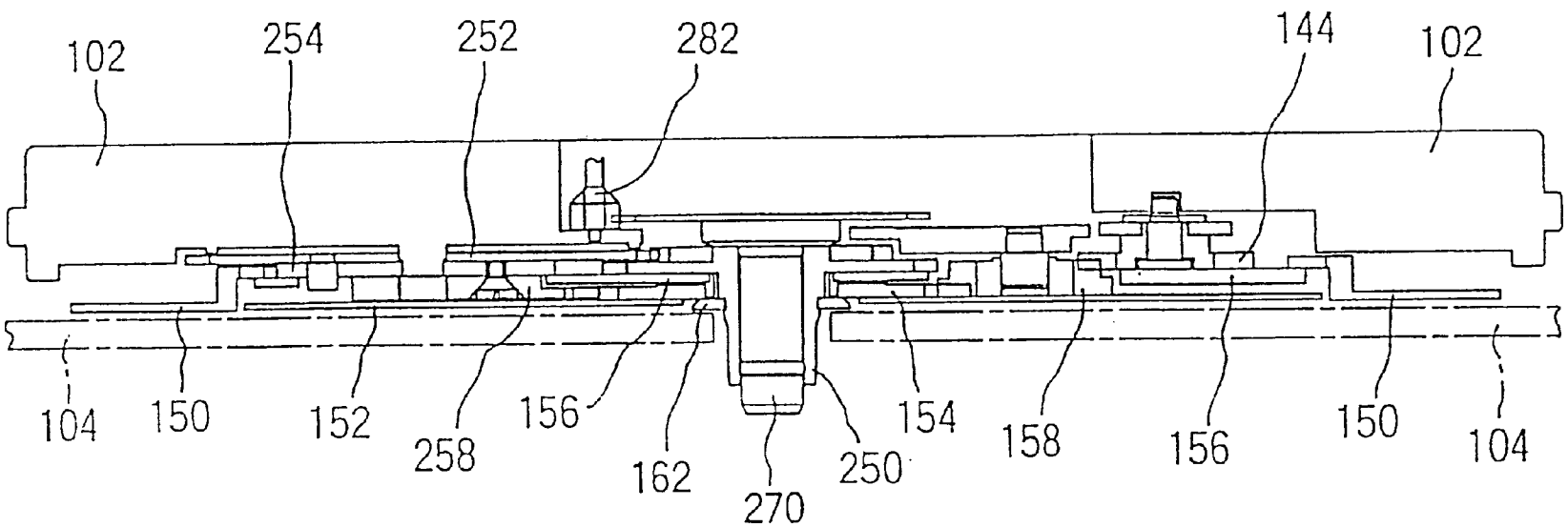
FIG. 8 is a partial sectional view of the first embodiment of the timepiece equipped with a display correction device according to the invention in the state in which the winding stem exists at the first stage and the day correction is carried out.

In reference to FIG. 6 through FIG. 8, when the winding stem 110 is rotated to the left (when the winding stem 110 is rotated in the counterclockwise direction in view from the outer side of the timepiece) in the state in which the winding stem 110 is disposed at the first stage, based on the rotation of the sliding pinion 114, the setting wheel 118 is rotated in the clockwise direction. Based on rotation of the setting wheel 128, the first correction transfer wheel 132 is rotated in the counterclockwise direction. Based on rotation of the first correction transfer wheel 132, the second correction transfer wheel 134 is rotated in the clockwise direction. Based on rotation of the second correction transfer wheel 134, the third correction transfer wheel is rotated in the counterclockwise direction. Then, the rocking lever 142 is rotated in the counterclockwise direction and the corrector setting wheel shaft portion 144*c* is positioned by being brought into contact with the cylindrical wall face of the rocking lever positioning hole 102*g* on a side proximate to the 9 o'clock side. Under the state, when the winding stem 110 is rotated to the left, the third correction transfer wheel 140 can be made to slip against the rocking lever 142.

Based on rotation of the third correction transfer wheel 140, the corrector setting wheel 144 is rotated in the clockwise direction at a position shown by FIG. 7. Based on such rotation of the corrector setting gear 144*b*, the day corrector setting wheel 158 is rotated in the counterclockwise direction. Then, based on rotation of the day corrector setting wheel 158, the day indicator 152 is rotated in the clockwise direction. The position in the rotational direction of the day indicator 150 is determined by a day jumper 182.

As has been explained, in the case of the timepiece equipped with the display correction device according to the invention, by rotating the winding stem 110 to the left in the state in which the winding stem 110 is disposed at the first stage, day correction can be carried out.

In reference to FIG. 8, the date feeding mechanism of the timepiece equipped with the display correction device according to the invention, includes a date indicator driving wheel 252 rotated by one rotation in 24 hours based on rotation of an hour wheel 250 rotated by one rotation in 12 hours and a date indicator driving finger 254.

Further, the day feed mechanism of the timepiece equipped with the display correction device according to the invention, includes a day indicator driving finger 258 for feeding the date indicator 152 by 2 teeth per day based on rotation of the date indicator driving wheel 252. The day indicator 152 is rotatably supported relative to the hour wheel 250 by a day indicator holding spacer 162.

(4) Structure and operation of the first embodiment of the timepiece equipped with the display correction device according to the invention under the state in which the winding stem is disposed at the second stage.

Figure 9:
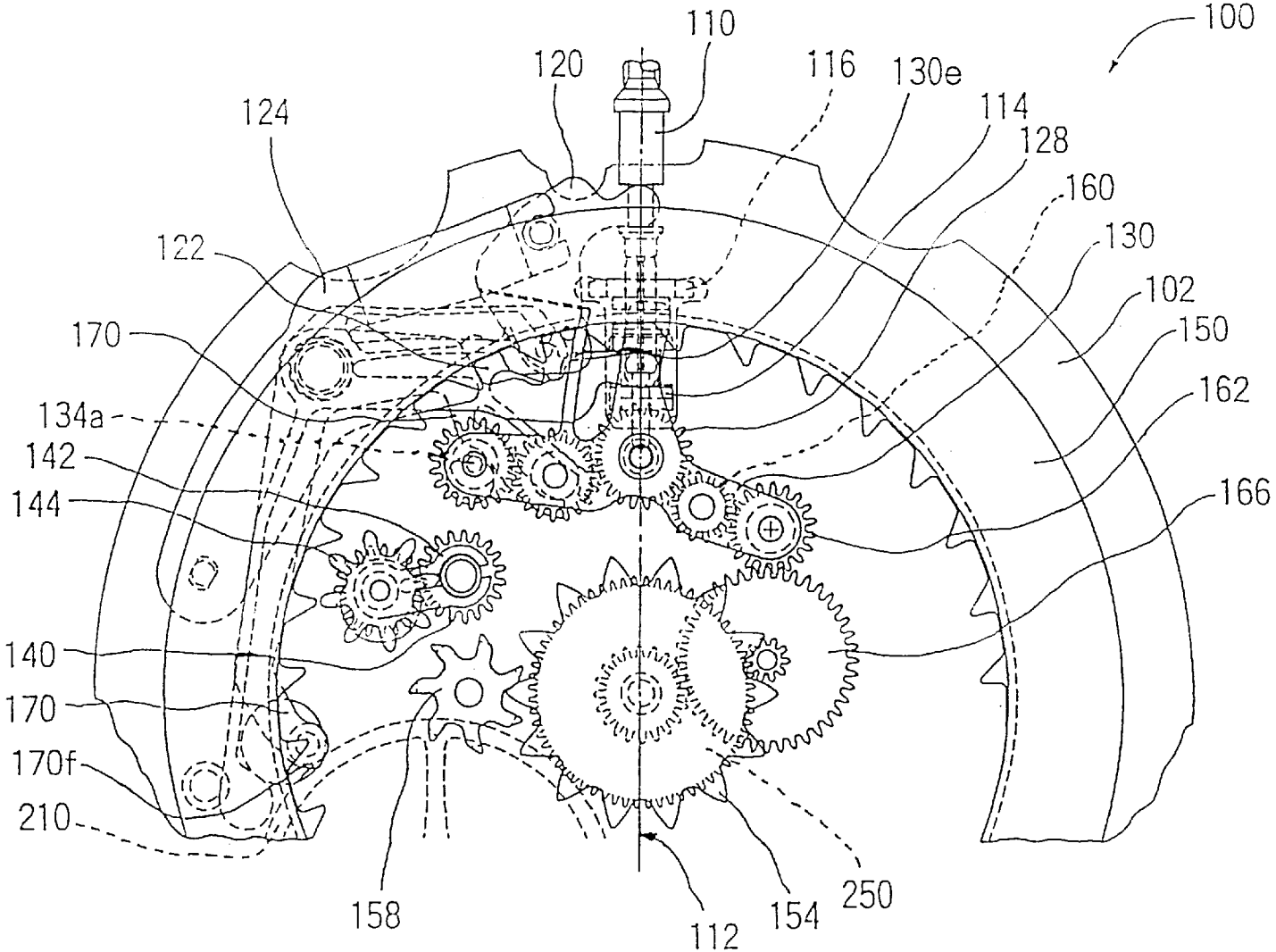
FIG. 9 is a partial plane view of the back side of the first embodiment of the timepiece equipped with the display correction device according to the invention in a state in which the winding stem exists at the second stage and time correction is carried out.
Figure 10:
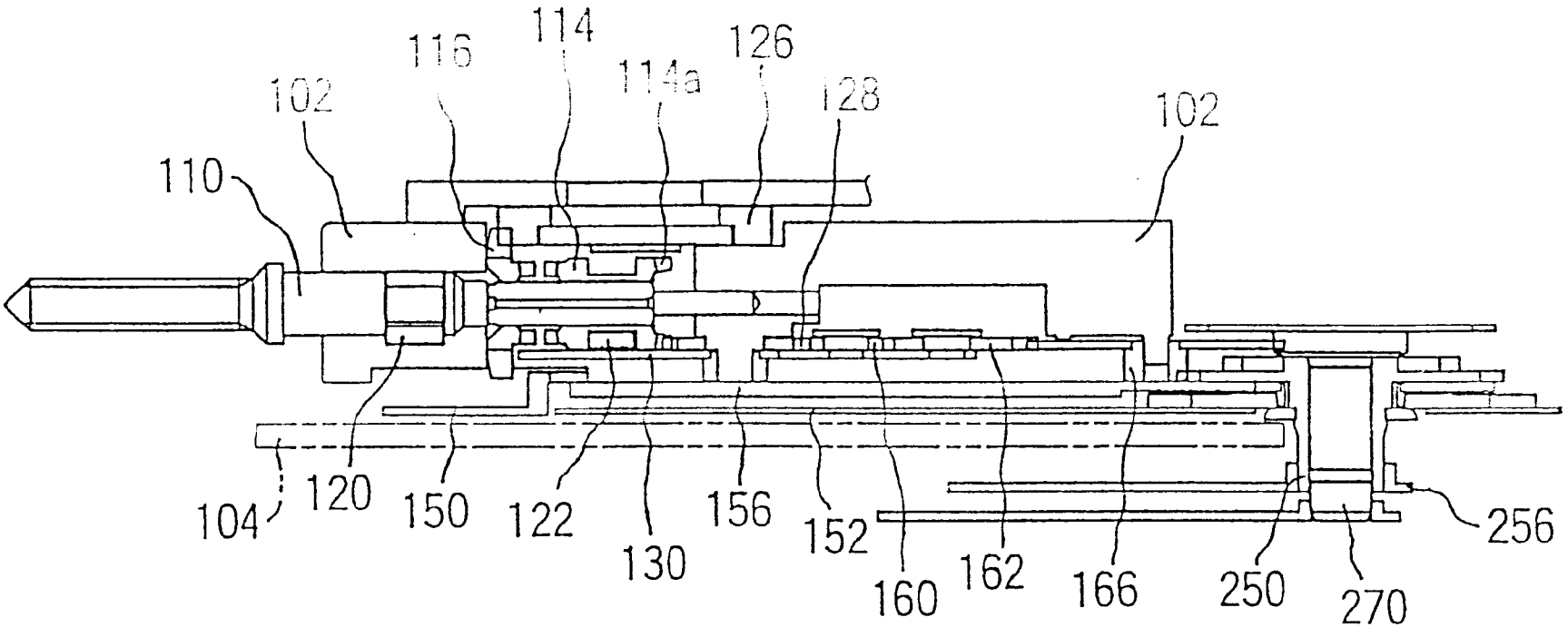
FIG. 10 is a partial sectional view of the first embodiment of the timepiece equipped with a display correction device according to the invention in the state in which the winding stem exists at the second stage and the time correction is carried out.
Figure 11:
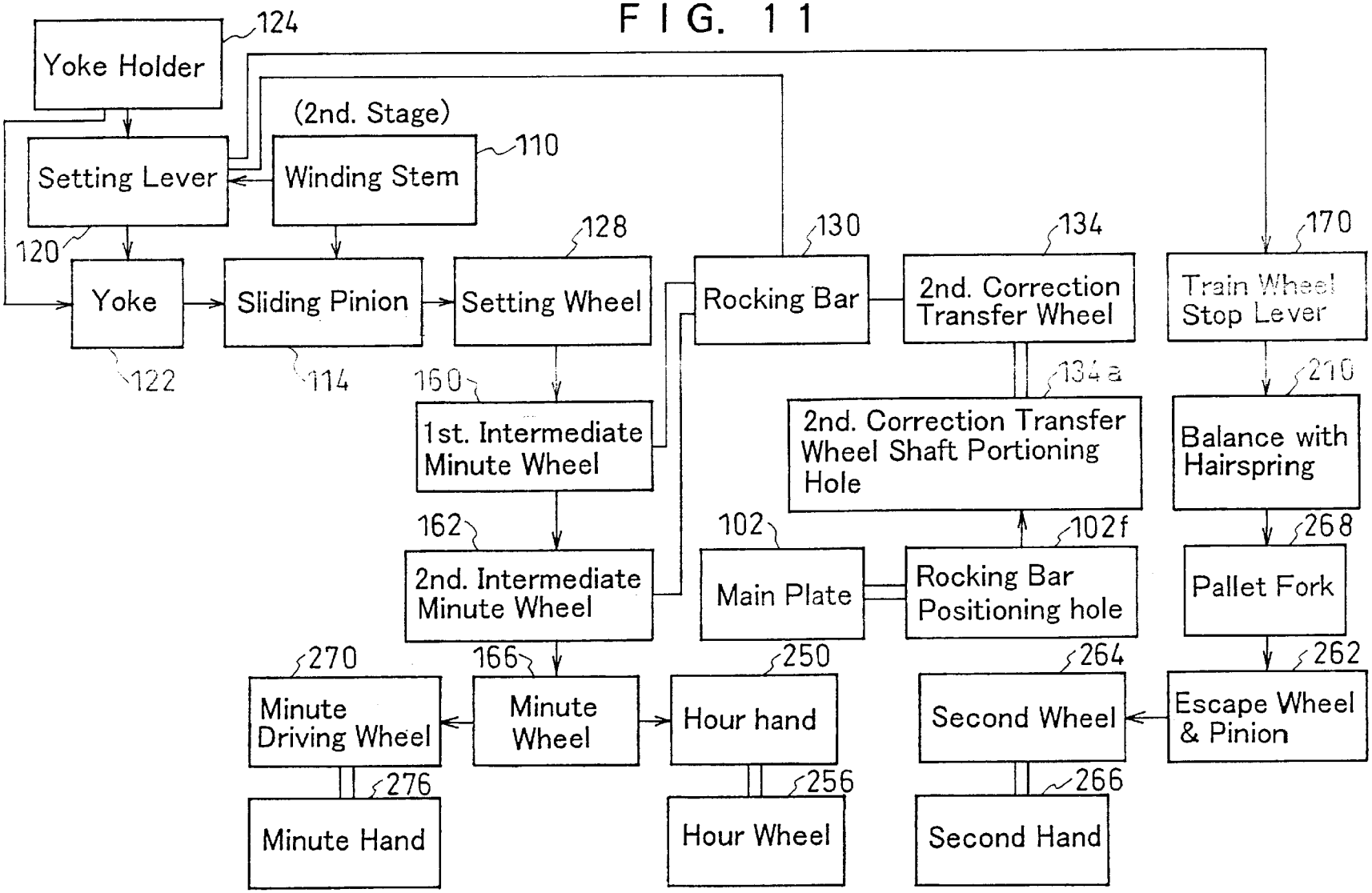
FIG. 11 is a functional block diagram of the first embodiment of the timepiece equipped with a display correction device according to the invention in the state in which the winding stem exists at the second stage and the time correction is carried out.

In reference to FIG. 9 through FIG. 11, the winding stem 110 is drawn by further one stage from the first stage to thereby bring about the state in which the winding stem 110 is disposed at the second stage. When the winding stem 110 is drawn by further one stage, the setting lever 120 is rotated further in the counterclockwise direction. In this operation, the yoke 122 is not rotated. Therefore, in the state in which the winding stem 110 is disposed at the second stage, similar to the state in which the winding stem 110 is disposed at the first stage, the A tooth 122*a* of the sliding pinion 114 stays to be in mesh with the setting wheel 128 and the B tooth 122*b* of the sliding pinion 114 is not in mesh with the winding pinion 116.

When the winding stem 110 is disposed at the second stage, by rotating the setting lever 120, the train wheel stop lever 170 is rotated in the counterclockwise direction, the train wheel stop operating portion 170*f* of the train wheel stop lever 170 is brought into contact with an outer periphery of a portion of a balance of the balance with hairspring 210 to thereby stop rotation of the balance with hairspring 210. As a result, a pallet fork 268 and an escape wheel & pinion 262 are not operated, rotation of the second indicator 264 is restrained and rotation of the second hand 266 is stopped.

The train wheel stop operating portion 170*f* of the train wheel stop lever 170 may be constituted by an end face of the train wheel stop lever 170 or may be constituted by orthogonally bending the end face of the train wheel stop lever 170 or may be constituted by fixing a separate pin for stopping train wheel at the end portion of the train wheel stop lever 170.

Further, by rotating the setting lever 120, a setting lever positioning pin 120*b* pushes the setting lever engaging portion 130*e* of the rocking bar 130. Then, the rocking bar 130 is rotated in the clockwise direction and the second correction transfer wheel shaft portion 134*a* is brought into contact with the cylindrical wall face of the rocking bar positioning hole 102*f* on a side proximate to the 3 o'clock side. Then, the second intermediate minute wheel 162 is in mesh with the minute wheel 166.

When the winding stem 110 is rotated to the right (when the winding stem 110 is rotated in the clockwise direction in view from the outer side of the timepiece), based on rotation of the sliding pinion 128, the first intermediate minute wheel 160 is rotated in the clockwise direction. Based on rotation of the first intermediate minute wheel 160, the second intermediate minute wheel 162 is rotated in the counterclockwise direction. Based on rotation of the second intermediate minute wheel 162, the minute wheel 166 is rotated in the clockwise direction. Based on rotation of the minute wheel 166, the hour wheel 250 and the minute driving wheel 260 are rotated in the counterclockwise direction. Therefore, when the winding stem 110 is disposed at the second stage, by rotating the winding stem 110 to the right, so-to-speak "inverse hand setting" can be carried out.

In contrast thereto, when the winding stem 110 is rotated to the left (when the winding stem 110 is rotated in the counterclockwise direction in view from the outer side of the timepiece), based on rotation of the sliding pinion 114, the setting wheel 128 is rotated in the clockwise direction. Based on rotation of the setting wheel 128, the first intermediate minute wheel 160 is rotated in the counterclockwise direction. Based on rotation of the first intermediate minute wheel 160, the second intermediate minute wheel 162 is rotated in the clockwise direction. Based on rotation of the second intermediate minute wheel 162, the minute wheel 166 is rotated in the counterclockwise direction. Based on rotation of the minute wheel 166, the hour wheel 250 and the minute driving wheel 260 are rotated in the clockwise direction. Therefore, when the winding stem 110 is disposed at the second stage, by rotating the winding stem 110 to the left, so-to-speak "regular hand setting" can be carried out.

By rotating the hour wheel 250, display content of "o'clock" which the hour hand 256 attached to the hour wheel 250 displays can be corrected. By rotating the minute driving wheel 270, display content of "minute" which the minute hand 276 attached to the minute driving wheel 270 displays can be corrected. Further, by operation of the train wheel stop lever 170, in a time period in which display content of "o'clock" and "minute" are being corrected, display content of "second" is not changed.

(5) Arrangement of parts of the first embodiment of the timepiece equipped with the display correction device according to the invention and total operation.

Figure 12:
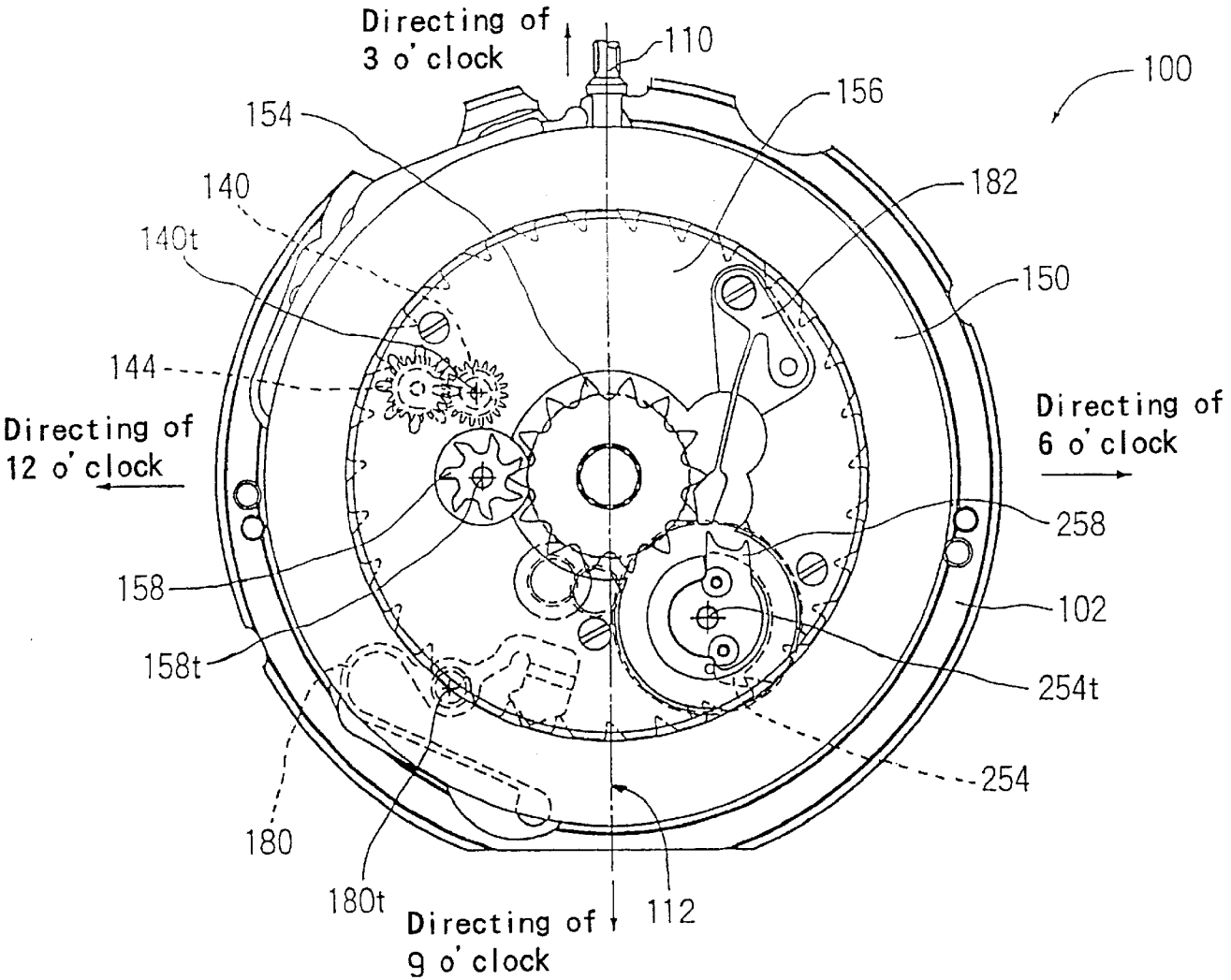
FIG. 12 is a plane view showing an outline of the structure of the back side of the first embodiment of the timepiece equipped with a display correction device according to the invention when the winding stem exists at the 0-th stage.
Figure 13:
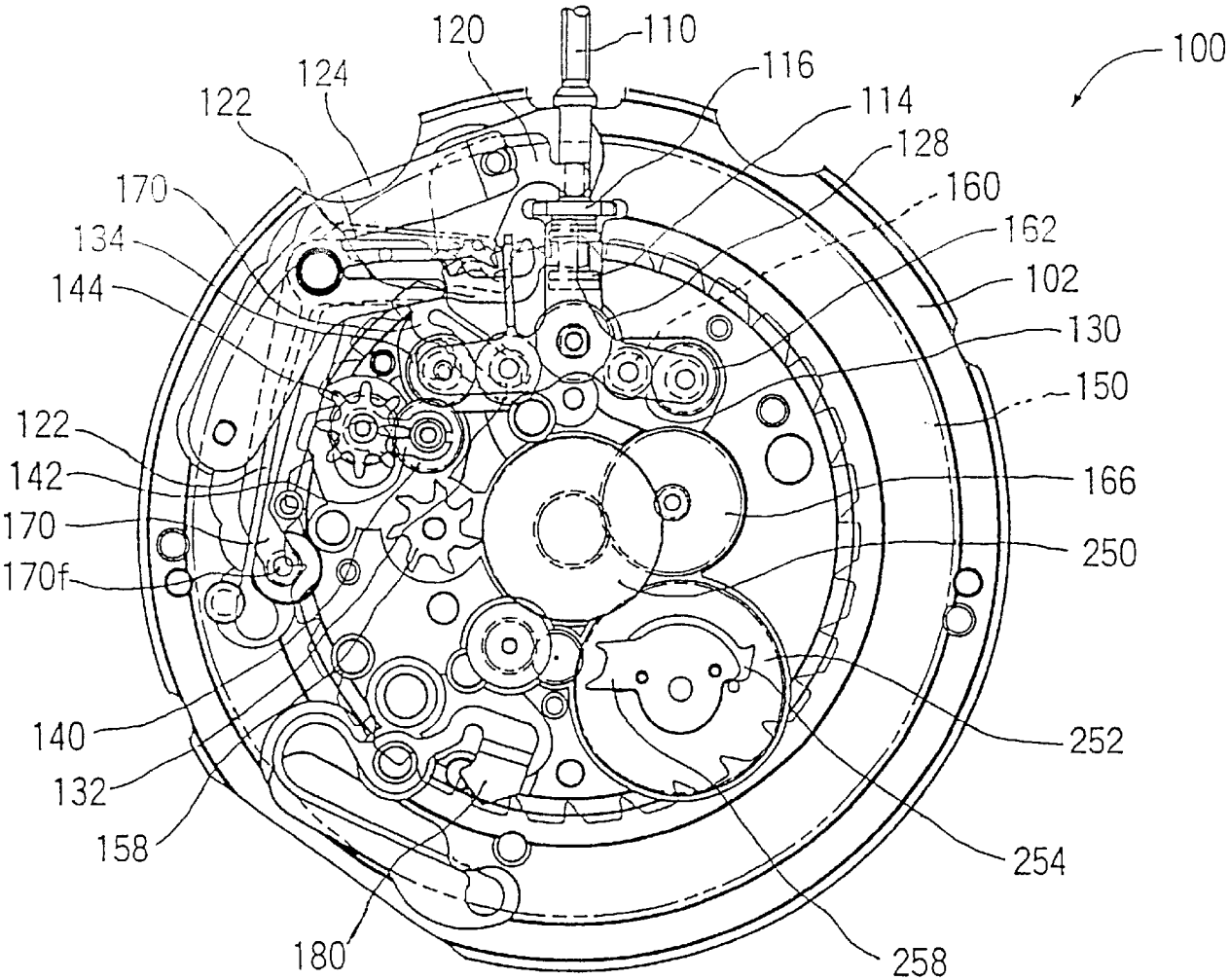
FIG. 13 is a plane view showing an outline of the structure of the back side of the first embodiment of the timepiece equipped with a display correction device according to the invention when the winding stem exist at the 0-th stage in a state in which a date indicator, a day indicator and a day jumper are removed.

In reference to FIG. 12 and FIG. 13, on the back side of the timepiece equipped with the display correction device according to the invention, there are arranged the date indicator 150, the day indicator 152 (including the day star wheel 154) and the switch device (including the setting lever, the yoke and the yoke holder).

A rotational center 254*t* of the date indicator driving finger 254 and the day driving finger 258 is arranged at the second region on the right side of the reference axis line 112 of the movement. The rotational center 254*t* of the date indicator driving finger 254 and the day indicator driving finger 258 is arranged at a region of a half of the second region remote from the winding stem 110 (referred to as "6 through 9 o'clock region"). Particularly, it is preferable to arrange the rotational center 254*t* of the date indicator driving finger 254 and the day indicator driving finger 258 is arranged substantially in the "8 o'clock direction" of the movement.

The date jumper 180 is arranged at the first region on the left side of the reference axis line 112 of the movement. The date jumper 180 is arranged at a region of a half of the first region remote from the winding stem 110 (referred to as "9 through 12 o'clock region" in correspondence with numerals of the dial). Particularly, it is preferable to arrange a rotational center 180*t* of the date jumper 180 substantially between the "10 o'clock direction" and the "11 o'clock direction" of the movement. It is preferable that a portion of the date jumper 180 engaged with the date indicator 150 is arranged substantially between the "9 o'clock direction" and the "10 o'clock direction".

The day jumper 182 is arranged at the second region on the right side of the reference axis line 112 of the movement. The day jumper 182 is arranged at a region of a half of the first region proximate to the winding stem 110 (referred to as "3 through 6 o'clock region" in correspondence with numerals of the dial). Particularly, it is preferable that a portion of the day jumper 182 engaged with the day indicator is arranged substantially between the "6 o'clock direction" and the "7 o'clock direction" of the movement.

A rotational center 158*t* of the day correction transfer wheel 158 is arranged at the first region on the left side of the reference axis line 112 of the movement. It is preferable that the rotational center 158*t* of the day correction transfer wheel 158 is arranged substantially in the "12 o'clock direction" of the movement.

A rotational center 140*t* of the third correction transfer wheel 140 is arranged at the first region on the left side of the reference axis line 112 of the movement. It is preferable that the rotational center 150*t* of the third correction transfer wheel 140 is arranged substantially in the "1 o'clock direction" of the movement.

Figure 14:
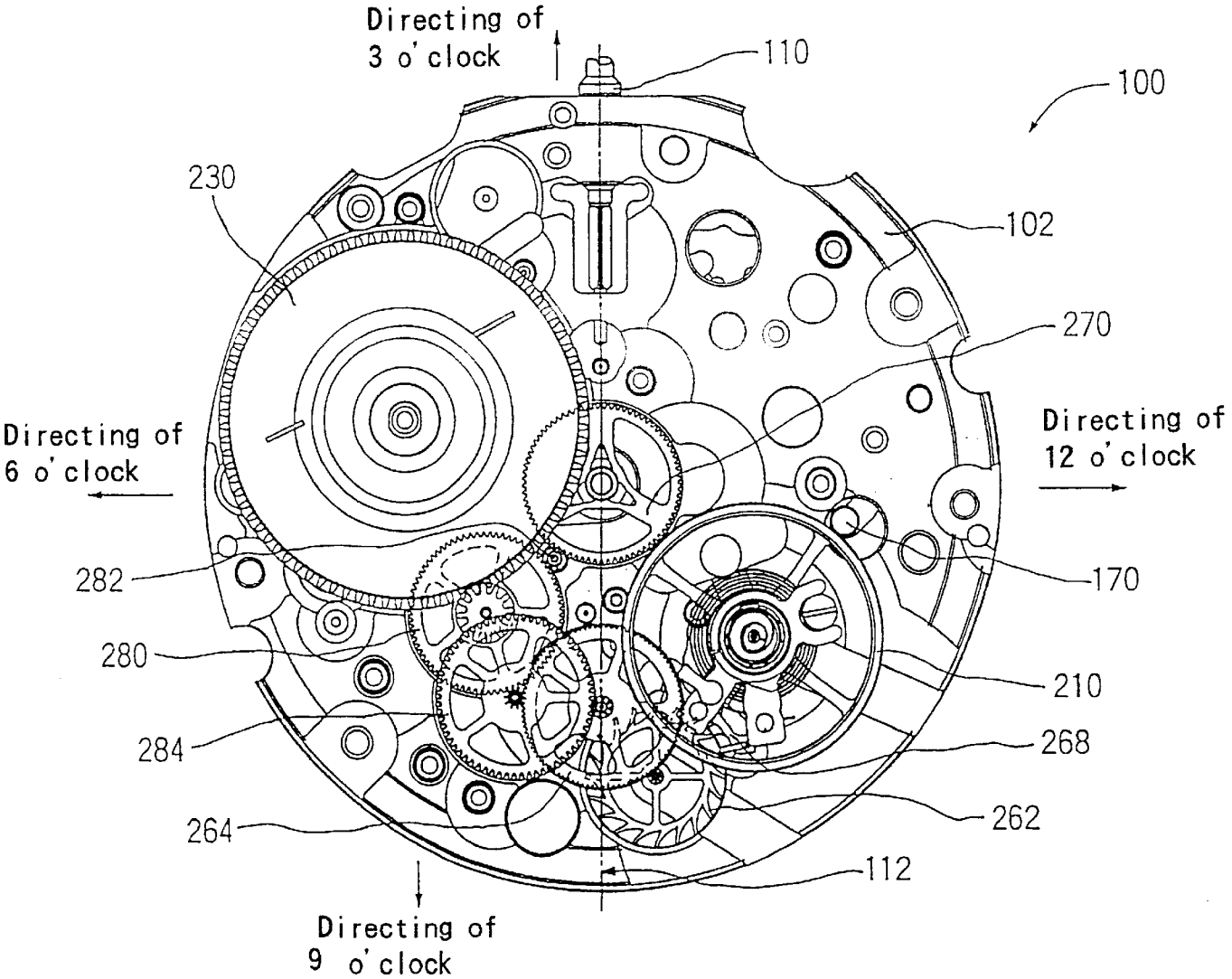
FIG. 14 is a plane view showing an outline of the structure of a front side of the first embodiment of the timepiece equipped with a display correction device according to the invention in the state in which the winding stem exists at the second stage and the time correction is carried out.

In reference to FIG. 14, on the front side of the timepiece equipped with the display correction device according to the invention, there are arranged the movement barrel complete 230, a center wheel & pinion 280, a third wheel & pinion 284, the minute driving wheel 270, a minute transmission pinion 282, the second wheel 264, the escape wheel & pinion 262, the pallet fork 268 and the balance with hairspring 210.

A rotational center of the movement barrel complete 230, a rotational center of the center wheel & pinion 280 and a rotational center of the third wheel & and pinion 284 are arranged on the second region on the left side of the reference axis line 112 of the movement. The rotational center of the movement barrel complete 230 is arranged at a region of a half of the second region proximate to the winding stem 110 (referred to as "3 through 6 o'clock region" in correspondence with numerals of the dial).

Particularly, it is preferable that the rotational center of the movement barrel complete 230 is arranged between the "5 o'clock direction" and the "6 o'clock direction" of the movement. The rotational center of the center wheel & pinion 280 and the rotational center of the third wheel & pinion 284 are arranged at a region of the second region remote from the winding stem 110 (referred to as "6 through 9 o'clock region" in correspondence with numerals of the dial).

The rotational center of the second wheel 264 is arranged on the reference axis line 112 of the movement at a position remote from the winding stem 110. Particularly, it is preferable that the rotational center of the second wheel 264 is arranged in the "9 o'clock direction" of the movement. The structure of the timepiece shown by FIG. 14 constitutes a timepiece having a so-to-speak "small second hand".

By changing the rotational centers of the center wheel & pinion 280, the third wheel & pinion 284 and the second wheel 264 and changing dimensions and numbers of teeth of respective train wheels, the rotational center of the second hand 266 can be arranged at the center of the movement. Such a structure constitutes a timepiece of so-to-speak "central three hands".

The rotational center of the escape wheel & pinion 262, the rotational center of the pallet fork 268 and the rotational center of the balance with hairspring 210 are arranged at the first region on the right side of the reference axis line 112 of the movement. The rotational center of the escape wheel & pinion 162, the rotational center of the pallet fork 268 and the rotational center of the balance with hairspring 210 are arranged at a region of a half of the first region remote from the winding stem 110 (referred to as "9 through 12 o'clock region" ). Particularly, it is preferable to arrange the rotational center of the balance with hairspring 210 between the "10 o'clock direction" and the "11 o'clock direction" of the movement.

It is preferable to arrange a portion of the train wheel stop lever 170 for restraining the balance with hairspring 210 between the "11 o'clock direction" and the "12 o'clock direction" of the movement.

Figure 15:
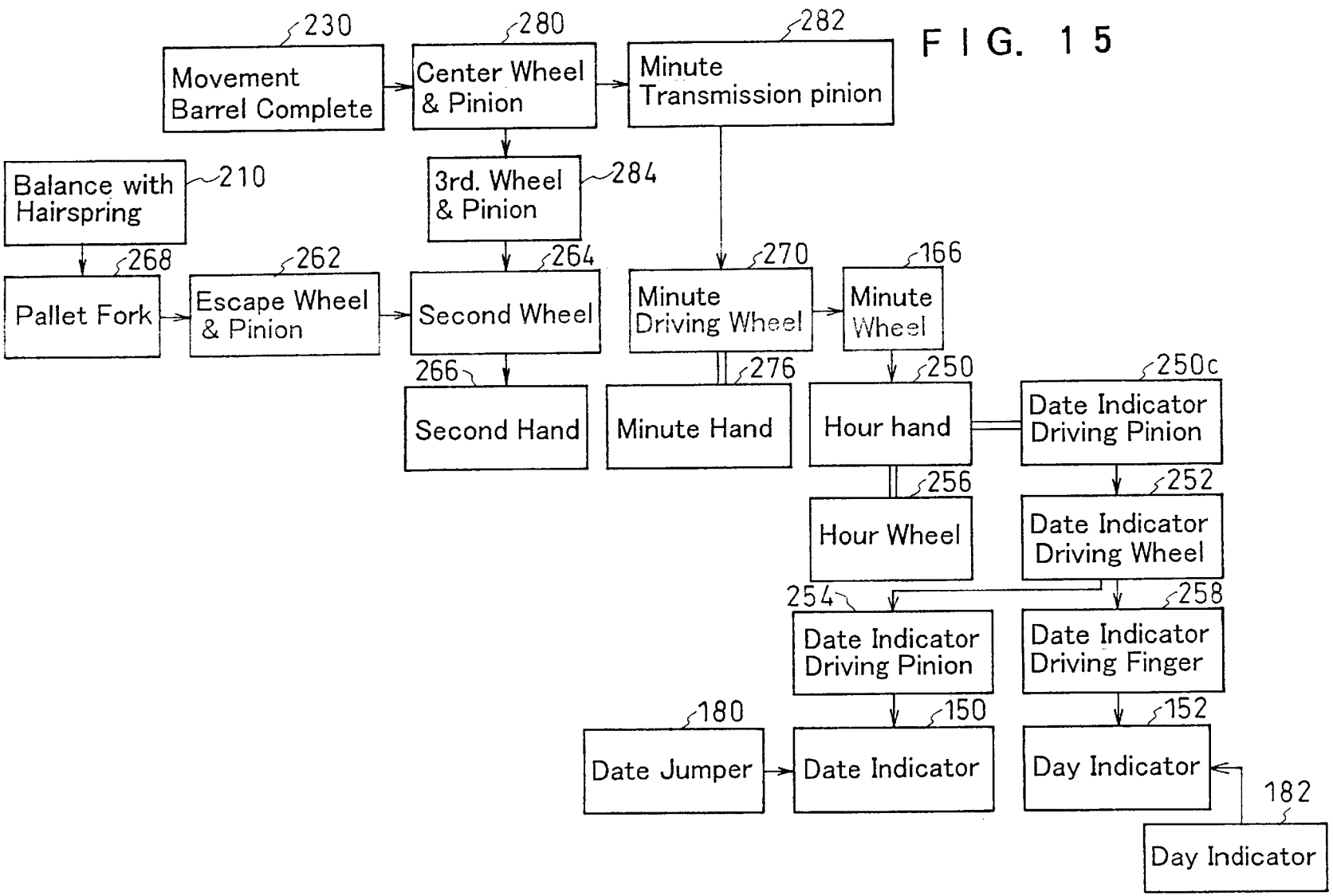
FIG. 15 is a functional block diagram showing operation of the first embodiment of the timepiece equipped with a display correction device according to the invention.

In reference to FIG. 15, in the case of the timepiece equipped with the display correction device according to the invention, the center wheel & pinion 280 is rotated with the mainspring contained in the movement barrel complete 230 as a power source. Based on rotation of the center wheel & pinion 280, the second wheel 264 is rotated via the third wheel & pinion 284. The second hand 266 attached to the second wheel 264 displays "second". The rotational speed of the second wheel 264 is controlled by the balance with hairspring 210, the pallet fork 268 and the escape wheel & pinion 262.

Further, based on rotation of the center wheel & pinion 280, the minute driving wheel 270 is rotated via the minute transmission pinion 282. The minute hand 276 attached to the minute driving wheel 270 displays "minute". The minute driving wheel 270 is provided with a slip mechanism.

Further, based on rotation of the minute driving wheel 270, the minute wheel 166 is rotated. Based on rotation of the minute wheel 166, the hour wheel 250 is rotated. The hour hand 256 attached to the hour wheel 250 displays "o'clock".

By rotating the date indicator driving pinion 250*c* provided integrally to the hour wheel 250, the date indicator driving wheel 252 is rotated. By rotating the date indicator driving wheel 252, the date indicator driving finger 254 feeds the date indicator 150 by one tooth per day. By rotating the date indicator driving wheel 252, the day indicator driving finger 258 feeds the day indicator 152 by two teeth per day. Rotation of the date indicator 150 is restrained by the date jumper 180. Rotation of the day indicator 152 is restrained by the day jumper 182.

(6) Structure of second embodiment of a timepiece equipped with a display correction device according to the invention.

Figure 16:
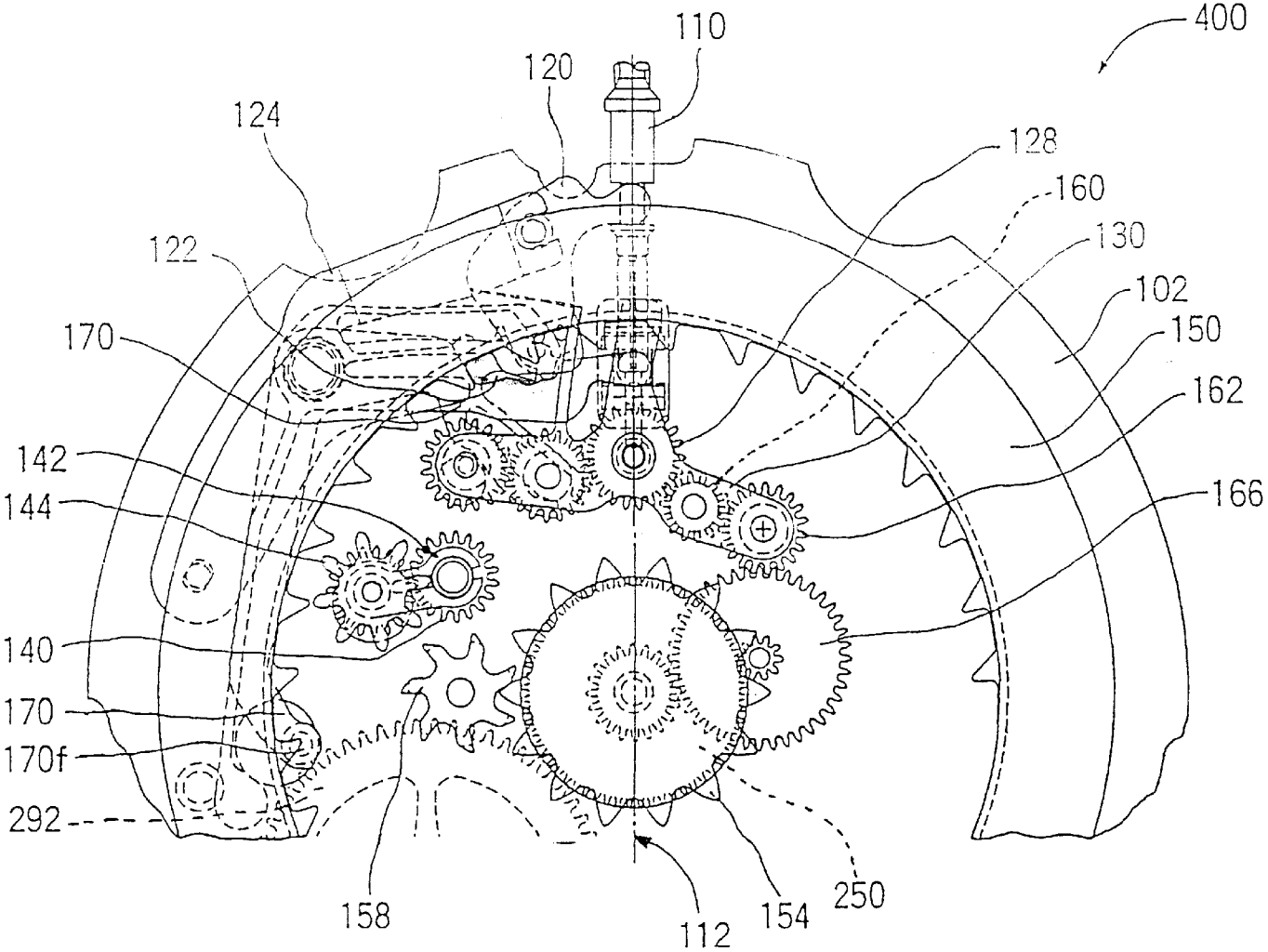
FIG. 16 is a plane view showing an outline of a structure of a back side of a second embodiment of a timepiece equipped with a display correction device according to the invention in a state in which a winding stem exists at a second stage and time correction is carried out.

In reference to FIG. 16, a movement 400 of a second embodiment of a timepiece equipped with a display correction device according to the invention is constituted by an analog electronic timepiece.

A point of the movement 400 of the second embodiment of the timepiece equipped with a display correction device according to the invention which differs from the movement 100 of the first embodiment of the timepiece equipped with the display correction device according to the invention, resides in the structure on the front side, that is, constitutions of a power source, a control device for controlling rotational speed of train wheel and front train wheel of the timepiece.

That is, a switch device, a back train wheel, a hand setting device, a date feed device, a day feed device, a date correction device and a day correction device are similar to those in the structure of the movement 100. Therefore, with regard to FIG. 16, an explanation of portions similar to those in the structure shown by FIG. 1 will be omitted.

A train wheel stop wheel 292 is arranged on the front side of the movement 400. The train wheel stop wheel 292 is in mesh with the second wheel 264 or a fourth wheel & pinion 290. In the case in which the movement 400 is a timepiece having a "small second hand", it is preferable that the train wheel stop wheel 294 is constituted to be in mesh with the second wheel 264. In the case in which the movement 400 is a timepiece having "center three hands", it is preferable that the train wheel stop wheel 292 is constituted to be in mesh with the fourth wheel & pinion 290.

The train wheel stop lever 170 is constituted to restrain the train wheel stop wheel 292 when the train wheel stop lever 170 is operated.

The rotational center of the train wheel stop wheel 292 is arranged at a region of a half of the first region of the movement remote from the winding stem 110 (referred to as "9 through 12 o'clock region" in correspondence with numerals of the dial). Particularly, it is preferable that the rotational center of the train wheel stop wheel 292 is arranged between the "10 o'clock direction" and the "11 o'clock direction" of the movement.

(7) Structure of a third embodiment of a timepiece equipped with a display correction device according to the invention.

Figure 17:
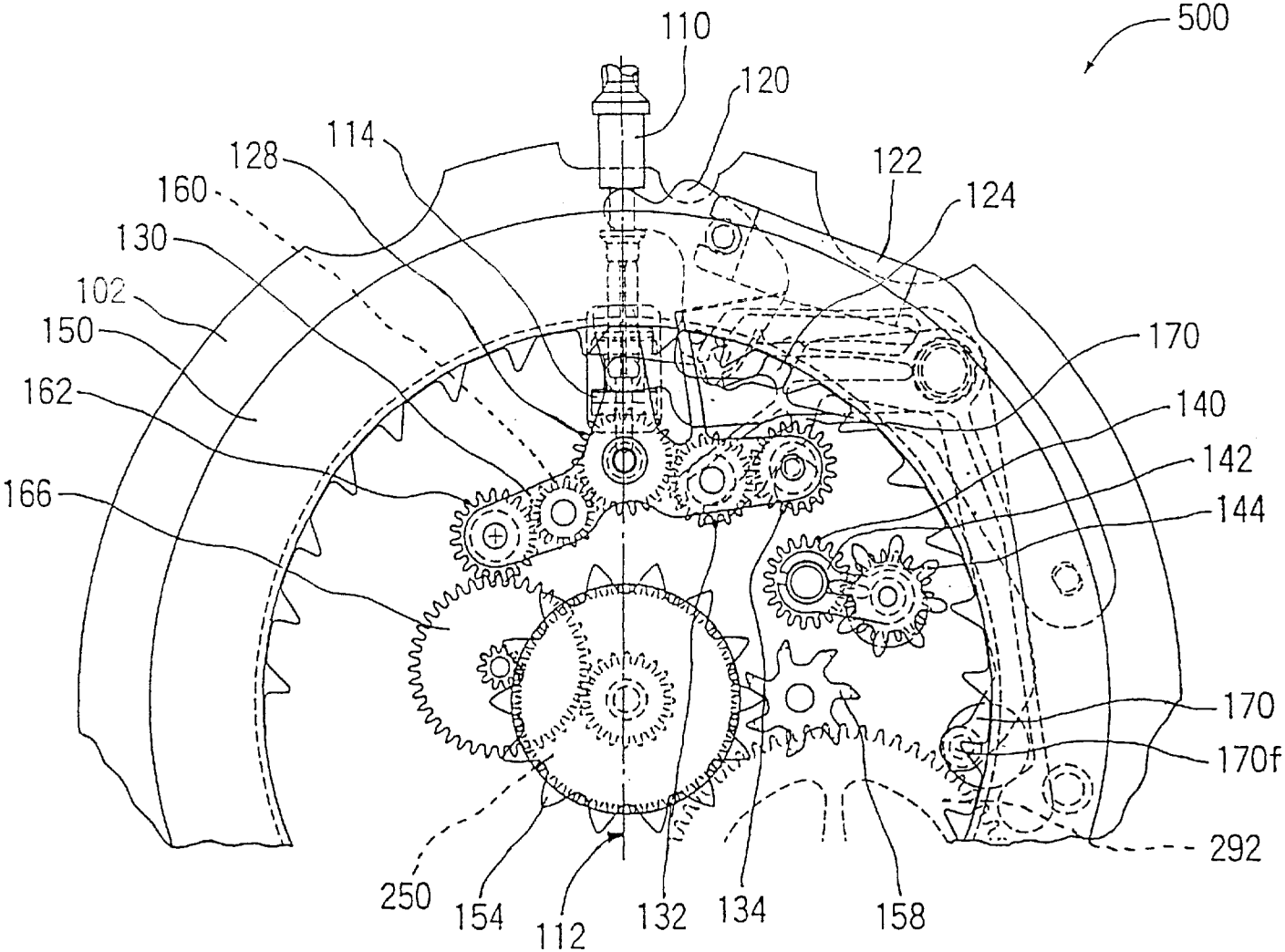
FIG. 17 is a plane view showing an outline of a structure of a back side of a third embodiment of a timepiece equipped with a display correction device according to the invention in a state in which a winding stem exits at the second stage and the time correction is carried out.

In reference to FIG. 17, a movement 500 of a third embodiment of a timepiece equipped with a display correction device according to the invention is constituted by an analog electronic timepiece.

A point of the movement 500 of the third embodiment of the timepiece equipped with a display correction apparatus according to the invention which differs from the movement 400 of the second embodiment of the timepiece equipped with the display correction device according to the invention, resides in that arrangement of parts on the front side and arrangement of parts on the back side are arranged in symmetry (mirror symmetry) with regard to the reference axis line 112.

Therefore, the rotational center of the train wheel stop wheel 292 is arranged at a region of a half of the second region of the movement remote from the winding stem 110 (referred to as "6 through 9 o'clock region" in correspondence with numerals of the dial). Particularly, it is preferable that the rotational center of the train wheel stop wheel 292 is arranged between the "7 o'clock direction" and the "8 o'clock direction" of the movement.

Although not particularly illustrated, also in the case in which a timepiece equipped with a display correction device according to the invention is constituted by a mechanical type timepiece, parts shown by FIG. 12 through FIG. 14 can be arranged in left and right symmetry (mirror symmetry) with regard to the reference axis line 112.

(8) Operation of second embodiment of a timepiece equipped with a display correction device according to the invention.

An explanation will be given of operation of a display correction device of the second embodiment of the timepiece equipped with the display correction device according to the invention.

Operation of a display correction device of the third embodiment of the timepiece equipped with the display correction device according to the invention, is substantially similar to operation of the display correction device of the second embodiment and accordingly, a detailed explanation thereof will be omitted here.

The movement 400 of the timepiece equipped with the display correction device according to the invention is not provided with a winding pinion and a winding device. When the winding stem 110 is disposed at the 0-th stage, there is no gear in mesh with the sliding pinion 114. It is not necessary to provide a B tooth to the sliding pinion 114.

According to the movement 400, in the state in which the winding stem 110 is disposed at the 0-th stage, when the winding stem 110 is rotated, only the sliding pinion 114 is rotated.

Operation in the state in which the winding stem 110 is disposed at the first stage, is similar to operation of the first embodiment of the timepiece equipped with the display correction device according to the invention.

Figure 18:
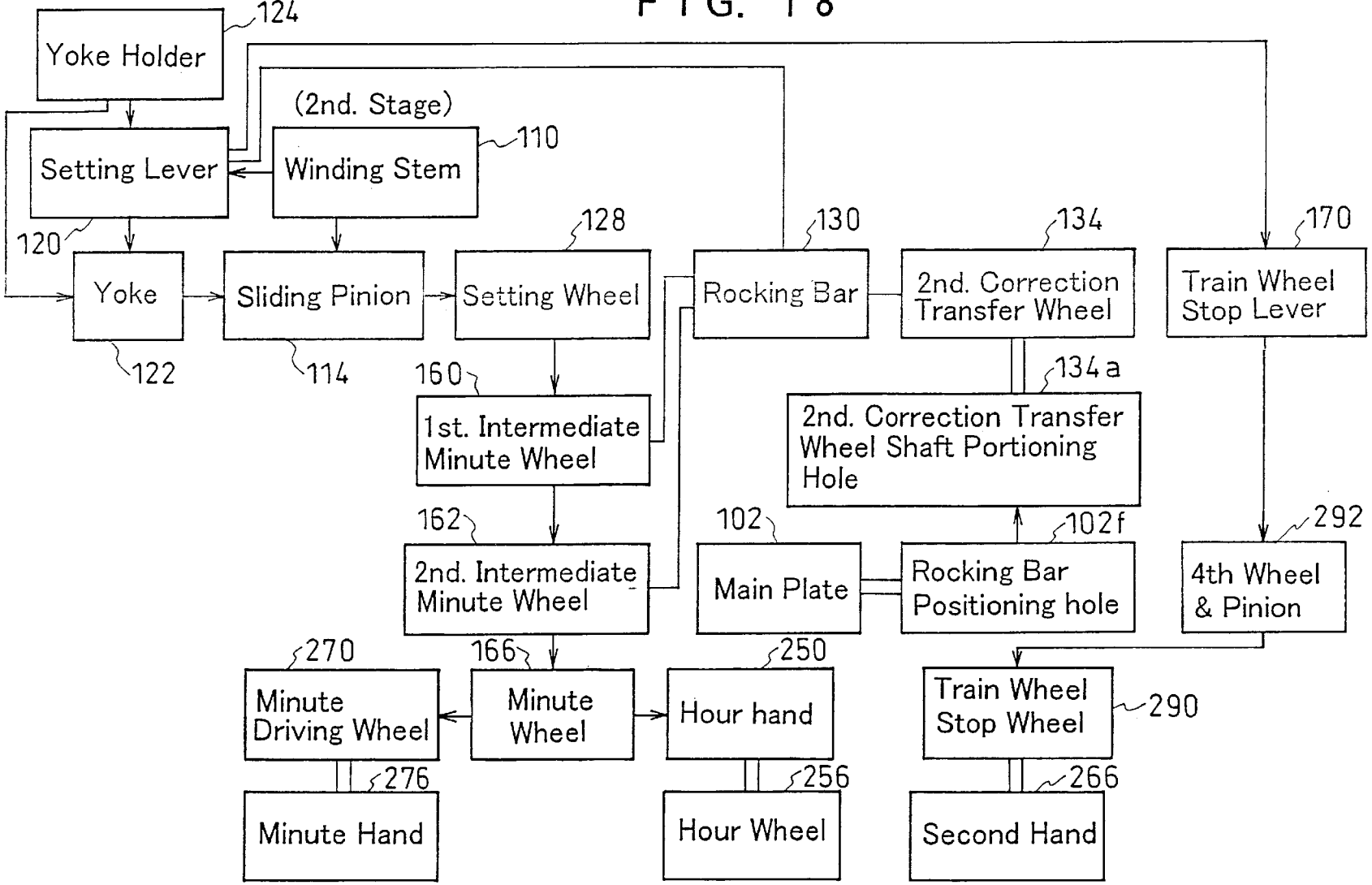
FIG. 18 is a functional block diagram of the second embodiment of the timepiece equipped with a display correction device according to the invention in the state in which the time setting stem exists at the second stage and the time correction is carried out.

In reference to FIG. 18, in the state in which the winding stem 110 is disposed at the first stage, the A tooth 122*a* of the sliding pinion 114 stays to be in mesh with the setting wheel 128.

By rotating the setting lever 120, the train wheel stop lever 170 is rotated in the counterclockwise direction and the train wheel stop operating portion 170*f* of the train wheel stop lever 170 is brought into contact with the train wheel stop wheel 292 and stops rotation of the train wheel stop wheel 292. As a result, rotation of the fourth wheel & pinion 290 in mesh with the train wheel stop wheel 292 is restrained and rotation of the second hand 266 is stopped.

Figure 19:
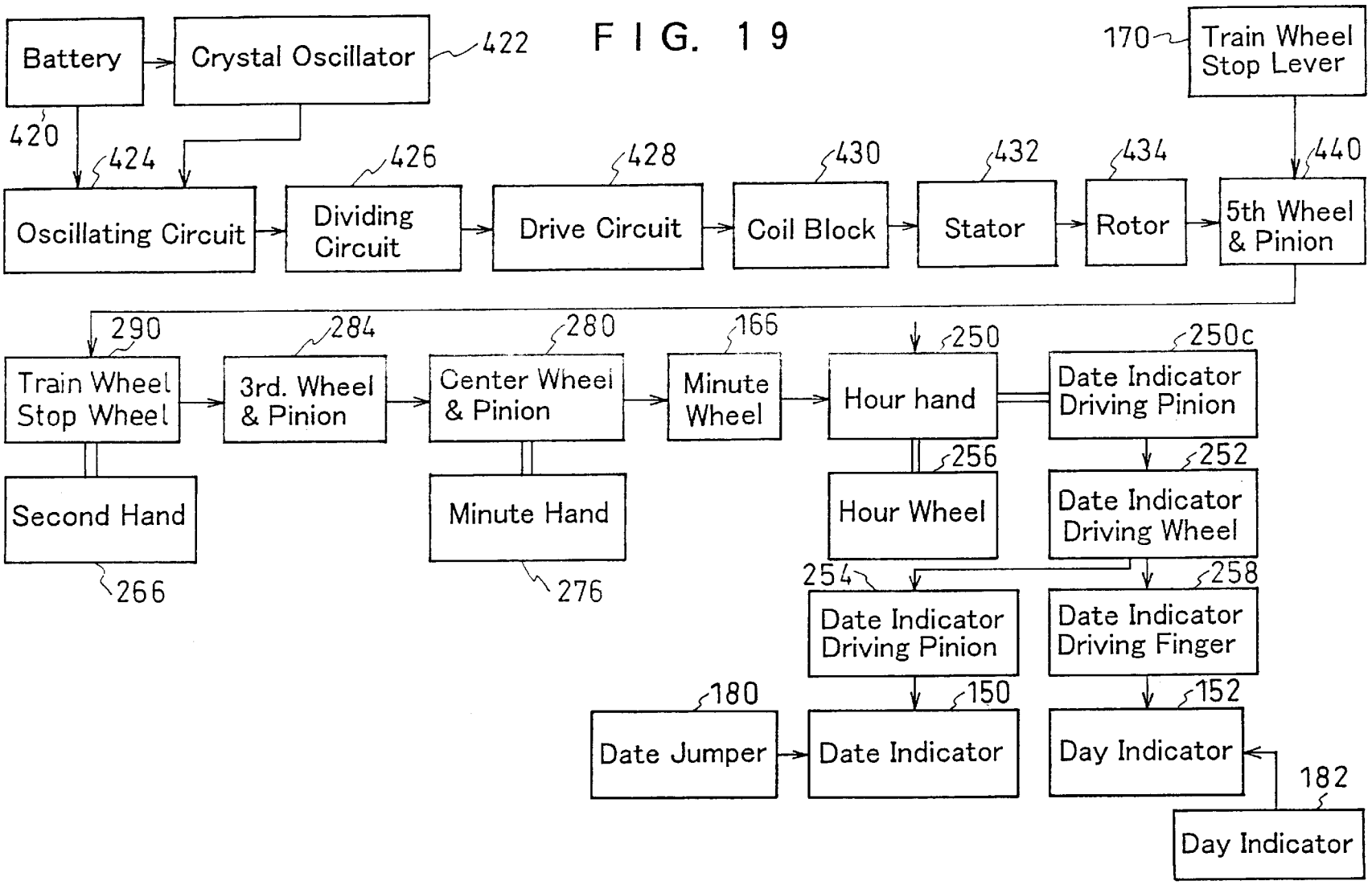
FIG. 19 is a functional block diagram showing operation of the second embodiment of the timepiece equipped with a display correction device according to the invention.

A gear restrained by the train wheel stop lever 170 may be the train wheel stop wheel 292 in mesh with the fourth wheel & pinion 290 or may be the fourth wheel & pinion 290. Further, as shown by FIG. 19, in the case of a timepiece in which the fourth wheel & pinion 290 and a fifth wheel & pinion 170 are provided and the second wheel 266 is attached to the fourth wheel & pinion 290, the fourth wheel & pinion 290 may be restrained or the fifth wheel & pinion 170 may be restrained.

According to the movement 400, operation of the rocking bar 130 by rotation of the setting lever 120 and operation of the setting wheel 128, the first intermediate minute wheel 160 and the second intermediate minute wheel 162 by rotation of the winding stem 110 are similar to those of the operation of the first embodiment of the timepiece equipped with the display correction device according to the invention.

Therefore, when the winding stem 110 is disposed at the second stage, by rotating the winding stem 110 to the right, so-to-speak "reverse hand setting" can be carried out and by rotating the winding stem 110 to the left, so-to-speak "regular hand setting" can be carried out.

A similar explanation is applicable also to the movement 500 shown by FIG. 17.

(9) Operation of total of the second embodiment and the third embodiment of the timepiece equipped with the display correction device according to the invention.

The second embodiment and the third embodiment of the timepiece equipped with the display correction device according to the invention are electric timepieces, for example, analog electric timepieces each having the display correction device.

In reference to FIG. 19, a battery 420 constitutes a power source of the timepiece and a crystal oscillator 422 is oscillated at, for example, 32,768 Hertz. Based on the oscillation of the crystal oscillator 422, an oscillating circuit 424 outputs a reference signal and a dividing circuit 426 divides an output signal of the oscillating circuit 424. Based on the output signal of the dividing circuit 426, a drive circuit 428 outputs a motor drive signal for driving a step motor. When a coil block 430 inputs the motor drive signal, a stator 432 is magnetized to thereby rotate a rotor 434. The rotor 434 is rotated by, for example, 180 degree per second.

Based on rotation of the rotor 434, the fourth wheel & pinion 290 is rotated via rotation of the fifth wheel & pinion 440. The fourth wheel & pinion 290 is constituted to rotate by one rotation per minute. The second hand 266 is attached to the fourth wheel & pinion 290.

The second wheel may be constituted to rotate via one or more train wheel based on rotation of the rotor 434. The fourth wheel & pinion 290 or the second wheel may be arranged at the center of the timepiece or may be arranged at a position different from the center of the timepiece.

The third wheel & pinion 284 is rotated based on rotation of the fourth wheel & pinion 290. The center wheel & pinion 280 is rotated based on rotation of the third wheel & pinion 284. A minute driving wheel may be used in place of the center wheel & pinion 280. The minute hand 276 is attached to the center wheel & pinion 280. The slip mechanism is provided to the center wheel & pinion 280 or the minute driving wheel. When hand setting is carried out by the slip mechanism, in the state in which the second hand 266 is stationary, by rotating the winding stem 110, the minute hand 276 and the hour hand 256 can be rotated. The center wheel & pinion 280 or the minute driving wheel is rotated once per hour.

The minute wheel 166 is rotated based on rotation of the center wheel & pinion 280. The hour wheel 250 is rotated based on rotation of the minute wheel 166. The hour wheel 250 is rotated once per 12 hours.

By rotating the date indicator driving pinion 250*c* of the hour wheel 250, the date indicator driving wheel 252 is rotated and the date indicator driving finger 254 feeds the date indicator 150 by one tooth per day. By rotating the date indicator driving wheel 252, the day indicator driving finger 258 feeds the day indicator 152 by 2 teeth per day. Rotation of the date indicator 150 is restrained by the date jumper 180. Rotation of the day wheel 152 is restrained by the day jumper 182.

Although according to the above-described embodiments, an explanation has been given with a number of teeth of the day star wheel as 14, the number of teeth of the day start wheel may be 7 or may be 21. In the case in which the number of teeth of the day star wheel is 7, the day indicator driving finger 258 is constituted to feed the day indicator 152 by 3 teeth per day.

Although according to the above-described embodiments, an explanation has been given of the timepiece having the second hand, the structure of the display correction device according to the invention is applicable also to a "two hands timepiece" or a "one hand timepiece" having no second hand.

Further, although according to the above-described embodiments, display members capable of being corrected when the winding stem 110 is disposed at the first stage, are the date indicator 150 and the day indicator 152, the structure of the display correction device according to the invention is applicable also to a timepiece having only the date indicator 150. Further, a plurality of display members to which the structure of the display correction device according to the invention is applicable, may be, for example, a month indicator, a moon phase indicator, a six day indicator, a year indicator and so on.

Industrial Applicability

As has been explained, the invention is constituted as described above in the timepiece equipped with the display correction device and accordingly, there are achieved effects described below.

(1) An amount of moving the sliding pinion in the axis line direction of the hand setting lever can be made smaller than that in the conventional structure and small-sized formation of a timepiece equipped with a display correction device can be realized.

(2) There can be realized a timepiece equipped with a display correction device having a small number of parts, having a simple structure easy to assemble and operated with certainty.

(3) A small-sized correction device for a timepiece can be realized.

What is claimed is:

1. A timepiece equipped with a display correction device for correcting a display content by rotation of a winding stem, comprising:

a first information display member for displaying first information;

a second information display member for displaying second information;

a winding stem having a rotational axis line for correcting a display content of the first information display member and correcting a display content of the second information display member;

a sliding pinion having a rotational axis line coinciding with the rotational axis line of the winding stem and mounted for rotation in accordance with rotation of the winding stem;

winding stem positioning means for positioning the winding stem at a first winding stem position in a direction of the rotational axis line, at a second winding stem position in the direction of the rotational axis line and at a third winding stem position in the direction of the rotational axis line;

sliding pinion positioning means for positioning the sliding pinion at a first sliding pinion position in the direction of the rotational axis line when the winding stem is disposed at the first winding stem position, and for positioning the sliding pinion at a second sliding pinion position in the direction of the rotational axis line when the winding stem is disposed at either the second winding stem position or the third winding stem position in accordance with movement of the winding stem in the direction of the rotational axis line;

a rocking bar having a rotational center on the rotational axis line of the winding stem and mounted for undergoing rocking movement in a first rotational direction when the winding stem is disposed at the second winding stem position and for undergoing rocking movement in a second rotational direction different from the first rotational direction when the winding stem is disposed at the third winding stem position;

first corrector setting means for correcting the display content of the first information display member in accordance with rotation of the sliding pinion when the winding stem is disposed at the second winding stem position; and second corrector setting means for correcting the display content of the second information display member in accordance with rotation of the sliding pinion when the winding stem is disposed at the third winding stem position.

2. A timepiece equipped with a display correction device according to claim 1; further comprising a setting wheel having a rotational center disposed at a position corresponding to a position of the rotational center of the rocking bar and mounted for rotation in accordance with rotation of the sliding pinion when the winding stem is disposed at the second winding stem position and the third winding stem position.

3. A timepiece equipped with a display correction device according to claim 2; wherein the first corrector setting means has at least one correction transfer wheel mounted for rotation in accordance with rotation of the setting wheel and a corrector setting wheel mounted for rotation in accordance with rotation of the correction transfer wheel for correcting the display content of the first information display member.

4. A timepiece equipped with a display correction device according to claim 3; further comprising a rocking lever for undergoing rocking movement in accordance with rotation of the correction transfer wheel when the winding stem is disposed at the second winding stem position, the corrector setting wheel being rotatably attached to the rocking lever.

5. A timepiece equipped with a display correction device according to claim 4; further comprising rocking lever positioning means for restraining the rocking lever at a position in a rotational direction of the rocking lever.

6. A timepiece equipped with a display correction device according to claim 5; further comprising rocking bar positioning means for restraining the rocking bar at a position in a rotational direction of the rocking bar.

7. A timepiece equipped with a display correction device according to claim 6; wherein the rocking bar undergoes rocking movement in accordance with operation of the winding stem positioning means.

8. A timepiece equipped with a display correction device according to claim 7; further comprising a train wheel stop lever for undergoing movement in accordance with operation of the winding stem positioning means for restraining operation of the second information display member when the winding stem is disposed at the third winding stem position.

9. A timepiece equipped with a display correction device according to claim 8; wherein the rocking bar undergoes rocking movement in accordance with operation of the winding stem positioning means when the winding stem is disposed at the third winding stem position.

10. A timepiece equipped with a display correction device according to claim 9; further comprising a third information display member for displaying third information; wherein when the winding stem is disposed at the second winding stem position, in the case in which the winding stem is rotated in a first winding stem rotating direction, the rocking lever is rotated in a first rocking lever rotating direction and the corrector setting wheel corrects the first information display member; and wherein when the winding stem is disposed at the second winding stem position, in the case in which the winding stem is rotated in a second winding stem rotating direction different from the first winding stem rotating direction, the rocking lever is rotated in a second rocking lever rotating direction different from the first rocking lever rotating direction and the corrector setting wheel corrects the third information display member.

11. A timepiece equipped with a display correction device according to claim 10; wherein the second correcting means comprises at least one intermediate minute wheel for undergoing rotation in accordance with rotation of the setting wheel, and a minute wheel for undergoing rotation in accordance with rotation of the intermediate minute wheel when the winding stem is disposed at the third winding stem position.

12. A timepiece equipped with a display correction device according to claim 9; further comprising a balance having a hairspring; wherein when the winding stem is disposed at the third winding stem position, the train wheel stop lever restrains the balance.

13. A timepiece equipped with a display correction device according to claim 9; further comprising a front train wheel for displaying second information and having a plurality of gears; and wherein when the winding stem is disposed at the third winding stem position, the train wheel stop lever restrains one of the gears of the front train wheel.

14. A timepiece equipped with a display correction device according to claim 1; wherein the first corrector setting means has at least one correction transfer wheel mounted for rotation in accordance with rotation of the setting wheel, and a corrector setting wheel mounted for rotation in accordance with rotation of the correction transfer wheel for correcting the display content of the first information display member.

15. A timepiece equipped with a display correction device according to claim 14; further comprising a rocking lever for undergoing rocking movement in accordance with rotation of the correction transfer wheel when the winding stem is disposed at the second winding stem position, the corrector setting wheel being rotatably attached to the rocking lever.

16. A timepiece equipped with a display correction device according to claim 1; further comprising rocking bar positioning means for restraining the rocking bar at a position in a rotational direction of the rocking bar.

17. A timepiece equipped with a display correction device according to claim 1; wherein the rocking bar undergoes rocking movement in accordance with operation of the winding stem positioning means.

18. A timepiece equipped with a display correction device according to claim 1; further comprising a train wheel stop lever for undergoing movement in accordance with operation of the winding stem positioning means for restraining operation of the second information display member when the winding stem is disposed at the third winding stem position.

19. A timepiece equipped with a display correction device according to claim 1; wherein the second correcting means comprises at least one intermediate minute wheel for undergoing rotation in accordance with rotation of the setting wheel, and a minute wheel for undergoing rotation in accordance with rotation of the intermediate minute wheel when the winding stem is disposed at the third winding stem position.

20. A timepiece equipped with a display correction device according to claim 2; further comprising rocking bar positioning means for restraining the rocking bar at a position in a rotational direction of the rocking bar.

21. A timepiece equipped with a display correction device according to claim 2; wherein the rocking bar undergoes rocking movement in accordance with operation of the winding stem positioning means.

22. A timepiece equipped with a display correction device according to claim 2; further comprising a train wheel stop lever for undergoing movement in accordance with operation of the winding stem positioning means for restraining operation of the second information display member when the winding stem is disposed at the third winding stem position.

23. A timepiece equipped with a display correction device according to claim 2; where in the second correcting means comprises at least one intermediate minute wheel for undergoing rotation in accordance with rotation of the setting wheel, and a minute wheel for undergoing rotation in accordance with rotation of the intermediate minute wheel when the winding stem is disposed at the third winding stem position.

24. A timepiece equipped with a display correction device according to claim 3; further comprising rocking bar positioning means for restraining the rocking bar at a position in a rotational direction of the rocking bar.

25. A timepiece equipped with a display correction device according to claim 3; wherein the rocking bar undergoes rocking movement in accordance with operation of the winding stem positioning means.

26. A timepiece equipped with a display correction device according to claim 3; further comprising a train wheel stop lever for undergoing movement in accordance with operation of the winding stem positioning means for restraining operation of the second information display member when the winding stem is disposed at the third winding stem position.

27. A timepiece equipped with a display correction device according to claim 3; where in the second correcting means comprises at least one intermediate minute wheel for undergoing rotation in accordance with rotation of the setting wheel, and a minute wheel for undergoing rotation in accordance with rotation of the intermediate minute wheel when the winding stem is disposed at the third winding stem position.

28. A timepiece equipped with a display correction device according to claim 4; further comprising rocking bar positioning means for restraining the rocking bar at a position in a rotational direction of the rocking bar.

29. A timepiece equipped with a display correction device according to claim 4; wherein the rocking bar undergoes rocking movement in accordance with operation of the winding stem positioning means.

30. A timepiece equipped with a display correction device according to claim 4; further comprising a train wheel stop lever for undergoing movement in accordance with operation of the winding stem positioning means for restraining operation of the second information display member when the winding stem is disposed at the third winding stem position.

31. A timepiece equipped with a display correction device according to claim 4; further compising a third information display member for displaying third information; wherein when the winding stem is disposed at the second winding stem position, in the case in which the winding stem is rotated in a first winding stem rotating direction, the rocking lever is rotated in a first rocking lever rotating direction and the corrector setting wheel corrects the first information display member; and wherein when the winding stem is disposed at the second winding stem position, in the case in which the winding stem is rotated in a second winding stem rotating direction different from the first winding stem rotating direction, the rocking lever is rotated in a second rocking lever rotating direction different from the first rocking lever rotating direction and the corrector setting wheel corrects the third information display member.

32. A timepiece equipped with a display correction device according to claim 4; wherein the second correcting means comprises at least one intermediate minute wheel for undergoing rotation in accordance with rotation of the setting wheel, and a minute wheel for undergoing rotation in accordance with rotation of the intermediate minute wheel when the winding stem is disposed at the third winding stem position.

33. A timepiece equipped with a display correction device according to claim 5; wherein the rocking bar undergoes rocking movement in accordance with operation of the winding stem positioning means.

34. A timepiece equipped with a display correction device according to claim 5; further comprising a train wheel stop lever for undergoing movement in accordance with operation of the winding stem positioning means for restraining operation of the second information display member when the winding stem is disposed at the third winding stem position.

35. A timepiece equipped with a display correction device according to claim 5; further comprising a third information display member for displaying third information; wherein when the winding stem is disposed at the second winding stem position, in the case in which the winding stem is rotated in a first winding stem rotating direction, the rocking lever is rotated in a first rocking lever rotating direction and the corrector setting wheel corrects the first information display member; and wherein when the winding stem is disposed at the second winding stem position, in the case in which the winding stem is rotated in a second winding stem rotating direction different from the first winding stem rotating direction, the rocking lever is rotated in a second rocking lever rotating direction different from the first rocking lever rotating direction and the corrector setting wheel corrects the third information display member.

36. A timepiece equipped with a display correction device according to claim 5; wherein the second correcting means comprises at least one intermediate minute wheel for undergoing rotation in accordance with rotation of the setting wheel, and a minute wheel for undergoing rotation in accordance with rotation of the intermediate minute wheel when the winding stem is disposed at the third winding stem position.

37. A timepiece equipped with a display correction device according to claim 6; further comprising a train wheel stop lever for undergoing movement in accordance with operation of the winding stem positioning means for restraining operation of the second information display member when the winding stem is disposed at the third winding stem position.

38. A timepiece equipped with a display correction device according to claim 6; further comprising a third information display member for displaying third information; wherein when the winding stem is disposed at the second winding stem position, in the case in which the winding stem is rotated in a first winding stem rotating direction, the rocking lever is rotated in a first rocking lever rotating direction and the corrector setting wheel corrects the first information display member; and wherein when the winding stem is disposed at the second winding stem position, in the case in which the winding stem is rotated in a second winding stem rotating direction different from the first winding stem rotating direction, the rocking lever is rotated in a second rocking lever rotating direction different from the first rocking lever rotating direction and the corrector setting wheel corrects the third information display member.

39. A timepiece equipped with a display correction device according to claim 6; wherein the second correcting means comprises at least one intermediate minute wheel for undergoing rotation in accordance with rotation of the setting wheel, and a minute wheel for undergoing rotation in accordance with rotation of the intermediate minute wheel when the winding stem is disposed at the third winding stem position.

40. A timepiece equipped with a display correction device according to claim 7; further comprising a third information display member for displaying third information; wherein when the winding stem is disposed at the second winding stem position, in the case in which the winding stem is rotated in a first winding stem rotating direction, the rocking lever is rotated in a first rocking lever rotating direction and the corrector setting wheel corrects the first information display member; and wherein when the winding stem is disposed at the second winding stem position, in the case in which the winding stem is rotated in a second winding stem rotating direction different from the first winding stem rotating direction, the rocking lever is rotated in a second rocking lever rotating direction different from the first rocking lever rotating direction and the corrector setting wheel corrects the third information display member.

41. A timepiece equipped with a display correction device according to claim 7; wherein the second correcting means comprises at least one intermediate minute wheel for undergoing rotation in accordance with rotation of the setting wheel, and a minute wheel for undergoing rotation in accordance with rotation of the intermediate minute wheel when the winding stem is disposed at the third winding stem position.

42. A timepiece equipped with a display correction device according to claim 8; further comprising a third information display member for displaying third information; wherein when the winding stem is disposed at the second winding stem position, in the case in which the winding stem is rotated in a first winding stem rotating direction, the rocking lever is rotated in a first rocking lever rotating direction and the corrector setting wheel corrects the first information display member; and wherein when the winding stem is disposed at the second winding stem position, in the case in which the winding stem is rotated in a second winding stem rotating direction different from the first winding stem rotating direction, the rocking lever is rotated in a second rocking lever rotating direction different from the first rocking lever rotating direction and the corrector setting wheel corrects the third information display member.

43. A timepiece equipped with a display correction device according to claim 8; wherein the second correcting means comprises at least one intermediate minute wheel for undergoing rotation in accordance with rotation of the setting wheel, and a minute wheel for undergoing rotation in accordance with rotation of the intermediate minute wheel when the winding stem is disposed at the third winding stem position.

44. A timepiece equipped with a display correction device according to claim 8; further comprising a balance having a hairspring; wherein when the winding stem is disposed at the third winding stem position, the train wheel stop lever restrains the balance.

45. A timepiece equipped with a display correction device according to claim 8; further comprising a front train wheel for displaying second information and having a plurality of gears; and wherein when the winding stem is disposed at the third winding stem position, the train wheel stop lever restrains one of the gears of the front train wheel.

46. A timepiece equipped with a display correction device according to claim 9; wherein the second correcting means comprises at least one intermediate minute wheel for undergoing rotation in accordance with rotation of the setting wheel, and a minute wheel for undergoing rotation in accordance with rotation of the intermediate minute wheel when the winding stem is disposed at the third winding stem position.

47. A timepiece equipped with a display correction device for correcting a display content by rotation of a winding stem, comprising:

a time display member for displaying time information;

a date display member for displaying date information;

a day display member for displaying day information;

a winding stem having a rotational axis line for correcting a display content of the time display member, the date display member and the day display member;

a sliding pinion having a rotational axis line coinciding with the rotational axis line of the winding stem for undergoing rotation in accordance with rotation of the winding stem;

a switch device for positioning the winding stem at a first winding stem position in a direction of the rotational axis line at a second winding stem position in the direction of the rotational axis line and at a third winding stem position in the direction of the rotational axis line, for positioning the sliding pinion at a first sliding pinion position in the direction of the rotational axis line when the winding stem is disposed at the first winding stem position, and for positioning the sliding pinion at a second sliding pinion position in the direction of the rotational axis line when the winding stem is disposed at either the second winding stem position or the third winding stem position in accordance with movement of the winding stem in the direction of the rotational axis line;

a rocking bar having a rotational center on the rotational axis line of the winding stem for undergoing rocking movement in a first rotational direction when the winding stem is disposed at the second winding stem position and for undergoing rocking movement in a second rotational direction different from the first rotational direction when the winding stem is disposed at the third position;

a setting wheel having a rotational center at a position coinciding with a position of the rotational center of the rocking bar for undergoing rotation in accordance with rotation of the sliding pinion when the winding stem is disposed at the second winding stem position and the third winding stem position;

a first corrector setting train wheel for correcting the display content of the date display member and the day display member in accordance with rotation of the setting wheel when the winding stem is disposed at the second winding stem position; and a second corrector setting train wheel for correcting the display content of the time display member in accordance with rotation of the setting wheel when the winding stem is disposed at the third winding stem position.

48. A timepiece equipped with a display correction device according to claim 14; wherein the first corrector setting train wheel has at least one correction transfer wheel for undergoing rotation in accordance with rotation of the setting wheel; and further comprising a rocking lever for undergoing rocking movement in accordance with rotation of the correction transfer wheel when the winding stem is disposed at the second winding stem position; and a corrector setting wheel attached to the rocking lever for undergoing rotation in accordance with rotation of the correction transfer wheel when the winding stem is disposed at the second winding stem position; wherein when the winding stem is disposed at the second winding stem position, in the case in which the winding stem is rotated in the first winding stem rotating direction, the rocking lever is rotated in a first rocking lever direction and the corrector setting wheel corrects the date display member; and wherein when the winding stem is disposed at the second hand setting position, in the case in which the winding stem is rotated in a second winding stem rotating direction different from the first winding stem rotating direction, the rocking lever is rotated in a second rocking lever rotating direction different from the first rocking lever rotating direction and the corrector setting wheel corrects the day display member.

49. A timepiece equipped with a display correction device according to claim 15; wherein the second corrector setting train wheel has at least one intermediate minute wheel for undergoing rotation in accordance with rotation of the setting wheel, and a minute wheel for undergoing rotation in accordance with rotation of the intermediate minute wheel when the winding stem is disposed at the third winding stem position.

50. A timepiece equipped with a display correction device according to claim 16; further comprising a train wheel stop lever for undergoing rotation in accordance with operation of the switch device for restraining operation of the time display member when the winding stem is disposed at the third winding stem position.

51. A timepiece equipped with a display correction device according to claim 47; wherein the second corrector setting train wheel has at least one intermediate minute wheel for undergoing rotation in accordance with rotation of the setting wheel, and a minute wheel for undergoing rotation in accordance with rotation of the intermediate minute wheel when the winding stem is disposed at the third winding stem position.

52. A timepiece equipped with a display correction device according to claim 47; further comprising a train wheel stop lever for undergoing rotation in accordance with operation of the switch device for restraining operation of the time display member when the winding stem is disposed at the third winding stem position.

53. A timepiece equipped with a display correction device according to claim 48; further comprising a train wheel stop lever for undergoing rotation in accordance with operation of the switch device for restraining operation of the time display member when the winding stem is disposed at the third winding stem position.

54. A timepiece equipped with a display correction device for correcting a display content by rotation of a winding stem, comprising:

a time display member for displaying time information;

a date display member for displaying date information;

a day display member for displaying day information;

a winding stem having a rotational axis line for correcting a display content of the time display member, the date display member and the day display member;

a sliding pinion having a rotational axis line coinciding with the rotational axis line of the winding stem for undergoing rotation in accordance with rotation of the winding stem;

a switch device for positioning the winding stem at a first winding stem position in a direction of the rotational axis line, at a second winding stem position in the direction of the rotational axis lines and at a third winding stem position in the direction of the rotational axis line, for positioning the sliding pinion at a first sliding pinion position in the direction of the rotational axis line when the winding stem is disposed at the first winding stem positions and for positioning the sliding pinion at a second sliding pinion position in the direction of the rotational axis line when the winding stem is disposed at either the second winding stem position or the third winding stem position based on movement of the winding stem in the direction of the rotational axis line;

a rocking bar having a rotational center on the rotational axis line of the winding stem for undergoing rocking movement in a first rotational direction when the winding stem is disposed at the second winding stem position and for undergoing rocking movement in a second rotational direction different from the first rotational direction when the winding stem is disposed at the third position;

a setting wheel having a rotational center at a position coinciding with a position of the rotational center of the rocking bar for undergoing rotation in accordance with rotation of the sliding pinion when the winding stem is disposed at the second winding stem position and the third winding stem position;

a first corrector setting train wheel for correcting the display content of the date display member and the day display member in accordance with rotation of the setting wheel when the winding stem is disposed at the second winding stem position; and a second corrector setting train wheel for correcting the display content of the time display member in accordance with the rotation of the setting wheel when the winding stem is disposed at the third winding stem position;

wherein the first corrector setting train wheel is arranged at a first region on a first side of a reference axis line of the timepiece when the rotational axis line of the winding stem coincides with the reference axis line of the timepiece; and wherein the second corrector setting train wheel is arranged at a second region on a second side of the reference axis line different from the first side.

55. A timepiece equipped with a display correction device according to claims 18; wherein the first corrector setting train wheel has at least one correction transfer wheel for undergoing rotation in accordance with rotation of the setting wheel; and further comprising a rocking lever for undergoing rocking movement in accordance with rotation of the correction transfer wheel when the winding stem is disposed at the second winding stem position, and a corrector setting wheel attached to the rocking lever for undergoing rotation in accordance with rotation of the correction transfer wheel when the winding stem is disposed at the second winding stem position; wherein when the winding stem is disposed at the second winding stem position, in the case in which the winding stem is rotated in the first winding stem rotating direction, the rocking lever is rotated in a first rocking lever direction and the corrector setting wheel corrects the date display member; and wherein when the winding stem is disposed at the second hand setting position, in the case in which the winding stem is rotated in a second winding stem rotating direction different from the first winding stem rotating direction, the rocking lever is rotated in a second rocking lever rotating direction different from the first rocking lever rotating direction and the corrector setting wheel corrects the day display member.

56. A timepiece equipped with a display correction device according to claim 19: further comprising a train wheel stop lever disposed in the first region relative to the reference axis line for undergoing movement in accordance with operation of the switch device for restraining operation of the time display member when the winding stem is disposed at the third winding stem position.

57. A timepiece equipped with a display correction device according to claim 54; further comprising a train wheel stop lever disposed in the first region relative to the reference axis line for undergoing movement in accordance with operation of the switch device for restraining operation of the time display member when the winding stem is disposed at the third winding stem position.

58. A timepiece equipped with a display correction device according to claim 54; wherein the second corrector setting train wheel has at least one intermediate minute wheel for undergoing rotation in accordance with rotation of the setting wheel; and further comprising a minute wheel disposed at the second region relative to the reference axis line for undergoing rotation in accordance with rotation of the second corrector setting train wheel via the intermediate minute wheel when the winding stem is disposed at the third winding stem position.

59. A correction device for a timepiece for correcting a display content based on rotation of a winding stem, comprising:

a setting wheel having a rotational center and rotatably mountable to a movement of a timepiece for undergoing rotation in accordance with rotation of a winding stem;

a rocking bar having a rotational center on an axis line coinciding with an axis line of the rotational center of the setting wheel and being mounted for undergoing rocking movement in a first rotational direction relative to the movement of the timepiece and undergoing rocking movement in a second rotational direction different from the first rotational direction, the rocking bar having a first portion extended in a first direction from the rotational center and a second portion extended in a second direction from the rotational center at least one first correction transfer wheel disposed at the first portion of the rocking bar for undergoing rotation in accordance with rotation of the setting wheel; and at least one second correction transfer wheel disposed at the second portion of the rocking bar for undergoing rotation in accordance with rotation of the setting wheel.

60. A display correction device comprising:

a winding stem mounted for undergoing rotation about a rotational axis thereof to first, second and third positions to correct a display content of at least one information display member for displaying information;

a sliding pinion connected to the winding stem for rotation therewith;

a winding pinion connected to the sliding pinion for rotation therewith when the winding stem is disposed at the first position;

a rocking bar mounted for undergoing rocking movement in a first rotational direction when the winding stem is disposed at the second position and for undergoing rocking movement in a second rotational direction different from the first rotational direction when the winding stem is disposed at the third position;

a first setting wheel mounted for undergoing rotation about a rotational center of the rocking bar in accordance with rotation of the sliding pinion; and a plurality of correction transfer wheels disposed on the rocking bar for undergoing rotation to correct the display content of the information display member in accordance with rotation of the first setting wheel when the winding stem is disposed at the second position.

* * * * *